US010625503B2

(12) United States Patent
Tomimatsu et al.

(10) Patent No.: US 10,625,503 B2
(45) Date of Patent: Apr. 21, 2020

(54) LIQUID EJECTION HEAD, LIQUID EJECTION APPARATUS, AND ELECTRONIC DEVICE

(71) Applicant: Seiko Epson Corporation, Tokyo (JP)

(72) Inventors: Shingo Tomimatsu, Matsumoto (JP); Daisuke Yamada, Hachioji (JP); Eiju Hirai, Azumino (JP); Motoki Takabe, Shiojiri (JP); Shunsuke Watanabe, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/287,094

(22) Filed: Feb. 27, 2019

(65) Prior Publication Data

US 2019/0263120 A1 Aug. 29, 2019

(30) Foreign Application Priority Data

Feb. 28, 2018 (JP) ..... 2018-034411

(51) Int. Cl.
*B41J 2/14* (2006.01)

(52) U.S. Cl.
CPC .. *B41J 2/14233* (2013.01); *B41J 2002/14419* (2013.01); *B41J 2002/14491* (2013.01); *B41J 2202/11* (2013.01); *B41J 2202/18* (2013.01)

(58) Field of Classification Search
CPC ..... B41J 2/14233; B41J 2002/14491; B41J 2002/11; B41J 2002/18; B41J 2002/14419
See application file for complete search history.

(56) References Cited

U.S. PATENT DOCUMENTS

2005/0190241 A1 9/2005 Lee et al.
2006/0213955 A1 9/2006 Watanabe
2016/0046123 A1* 2/2016 Yamagishi ..... B41J 2/16508 347/14
2016/0089877 A1* 3/2016 Yazaki ..... B41J 2/045 347/70
2017/0210133 A1 7/2017 Tsukahara et al.
(Continued)

FOREIGN PATENT DOCUMENTS

JP 2001-196414 A 7/2001
JP 2005-238845 A 9/2005
JP 2006-297895 A 11/2006
(Continued)

*Primary Examiner* — Lamson D Nguyen
(74) *Attorney, Agent, or Firm* — Harness, Dickey & Pierce, P.L.C.

(57) ABSTRACT

In a plan view from a perpendicular direction to a surface of a wiring substrate on which a wiring is provided, a buried wiring, a connection wiring, and a terminal portion of an external wiring are formed at an overlapping position, in which a recessed portion is provided at a position corresponding to the buried wiring on a surface of the connection wiring on an opposite side to the wiring substrate, and in which, in a direction intersecting an extension direction of the wiring on the surface of the wiring substrate on which the wiring is provided, a width of the connection wiring is larger than a width of the buried wiring, a width of the terminal portion of the external wiring is larger than a width of the recessed portion, and the terminal portion is provided across the recessed portion of the connection wiring.

20 Claims, 14 Drawing Sheets

(56) References Cited

U.S. PATENT DOCUMENTS

| | | | | |
|---|---|---|---|---|
| 2017/0217177 | A1* | 8/2017 | Takabe | H01L 41/0475 |
| 2017/0225457 | A1 | 8/2017 | Watanabe et al. | |

FOREIGN PATENT DOCUMENTS

| | | | |
|---|---|---|---|
| JP | 2017-124540 | A | 7/2017 |
| JP | 2017-132044 | A | 8/2017 |
| JP | 2017-140821 | A | 8/2017 |

* cited by examiner

LIQUID EJECTION HEAD, LIQUID EJECTION APPARATUS, AND ELECTRONIC DEVICE

The entire disclosure of Japanese Patent Application No. 2018-034411, filed Feb. 28, 2018 is expressly incorporated by reference herein.

BACKGROUND

1. Technical Field

The present invention relates to a liquid ejection head ejecting a liquid from a nozzle, a liquid ejection apparatus including the liquid ejection head, and an electronic device including a wiring substrate on which wirings are provided.

2. Related Art

An electronic device such as a micro electro mechanical systems (MEMS) device typified by a liquid ejection head includes a wiring substrate on which wirings are provided.

The wirings provided on the wiring substrate preferably have small electric resistance values, but, in order to dispose the wirings at high density with high accuracy, or in order to mount electronic components on the wirings, it is necessary to reduce heights of the wirings.

In a case where wirings are provided on a surface of a wiring substrate, it is hard to pattern a thick wiring with high accuracy at high density due to a restriction of a photolithography method, and thus only a relatively thin wiring can be formed. In a case where, in order to reduce an electric resistance value of a relatively thin wiring, a width of the wiring is increased, a space for providing the wiring is necessary, and thus a wiring substrate becomes large-sized.

Thus, a configuration has been proposed in which a groove is provided in a wiring substrate, a wiring is provided in the groove, and thus an electric resistance value is reduced by reducing the height of the wiring (for example, refer to JP-A-2017-124540).

However, in a case where a wiring is provided in a groove of a wiring substrate, a surface of the wiring of the groove is lower than a surface of the wiring substrate, and thus there is a problem in that it is hard to connect the wiring to a terminal portion of an external wiring, and thus a connection defect easily occurs. Particularly, in a case where wirings are disposed at high density, a condition method between a wiring and a terminal portion of an external wiring is restricted, and thus there is a problem in that it is hard to connect the wiring lower than a surface of a wiring substrate to the terminal portion of the external wiring.

Such a problem is not limited to a liquid ejection head typified by an ink jet type recording head, and also occurs in other electronic devices.

SUMMARY

An advantage of some aspects of the invention is to provide a liquid ejection head, a liquid ejection apparatus, and an electronic device, capable of reducing an electric resistance value of a wiring, and reliably connecting a wiring to an external wiring.

According to an aspect of the invention, there is provided a liquid ejection head including a channel formation substrate that is provided with a pressure generation chamber which communicates with a nozzle ejecting a liquid; a drive element that is provided on the channel formation substrate and causes a pressure change in the pressure generation chamber; and a wiring substrate that is provided with a wiring connected to a terminal portion of an external wiring, in which the wiring provided on the wiring substrate includes a buried wiring buried in a groove provided in the wiring substrate, and a connection wiring covering a surface of the buried wiring, in which, in a plan view from a perpendicular direction to a surface of the wiring substrate on which the wiring is provided, the buried wiring, the connection wiring, and the terminal portion of the external wiring are formed at an overlapping position, in which a recessed portion is provided at a position corresponding to the buried wiring on a surface of the connection wiring on an opposite side to the wiring substrate, and in which, in a direction intersecting an extension direction of the wiring on the surface of the wiring substrate on which the wiring is provided, a width of the connection wiring is larger than a width of the buried wiring, a width of the terminal portion of the external wiring is larger than a width of the recessed portion, and the terminal portion is provided across the recessed portion of the connection wiring.

In this case, since the wiring substrate, the connection wiring, and the terminal portion are disposed at an overlapping position in a plan view of the wiring substrate, the buried wiring and the external wiring can be provided to be close to each other, it is possible to reduce a portion having a great electric resistance value, configured with only the connection wiring and thus to suppress a voltage drop in the middle of the wiring. Even in a case where the terminal portion of the external wiring is connected to the buried wiring at the overlapping position in order to reduce the portion of the wiring having a great electric resistance value, since the width of the terminal portion of the external wiring is larger than the width of the recessed portion, and the terminal portion is provided across the recessed portion, the terminal portion can be reliably connected to the connection wiring close to the buried wiring, and thus it is possible to suppress a voltage drop in the connection portion by suppressing a reduction in a contact area with the external wiring. Since the buried wiring is covered with the connection wiring, it is possible to suppress the occurrence of migration between wirings adjacent to each other, and also to reliably connect the wiring and the external wiring to each other. A process of removing the recessed portion of the connection wiring is not necessary, and thus it is possible to reduce cost.

In the liquid ejection head, in the direction intersecting the extension direction of the wiring on the surface of the wiring substrate on which the wiring is provided, the width of the terminal portion is preferably larger than the width of the buried wiring. Consequently, the recessed portion can be easily formed without performing special processing on the connection wiring, by forming the connection wiring at a substantially uniform thickness. Since the width of the terminal portion is larger than the width of the buried wiring, the terminal portion can be reliably connected to the connection wiring in which the recessed portion is not formed and is close to the buried wiring.

The wiring having the buried wiring is preferably a wiring for a drive signal. Consequently, the buried wiring is provided in the wiring through which a relatively large current flows, and thus it is possible to reduce poor supply. Since the terminal portion is connected to a position of the wiring not in contact with the recessed portion, even if the buried wiring is not provided in the wiring through which a relatively small current flows, portions of the wiring having the buried wiring and the wiring not having the buried wiring connected to the terminal portions can be made to have an identical height, and thus the terminal portions can be relatively connected to the respective wirings. The buried wiring is not provided in some wirings, and thus it is possible to dispose the wirings at high density and also to miniaturize the wiring substrate.

The wiring having the buried wiring is preferably a wiring for a power source and a ground. Consequently, the buried wiring is provided in the wiring through which a relatively large current flows, and thus it is possible to reduce poor supply. Since the terminal portion is connected to a position of the wiring not in contact with the recessed portion, even if the buried wiring is not provided in the wiring through which a relatively small current flows, portions of the wiring having the buried wiring and the wiring not having the buried wiring connected to the terminal portions can be made to have an identical height, and thus the terminal portions can be relatively connected to the respective wirings. The buried wiring is not provided in some wirings, and thus it is possible to dispose the wirings at high density and also to miniaturize the wiring substrate.

Preferably, the wiring substrate is provided with a drive circuit having a switching element for driving the drive element, and at least a part of the wiring connects the external wiring to the drive circuit. Consequently, since the drive circuit is mounted on the wiring substrate, even if there is a restriction in a height for providing the wiring, the wiring having the buried wiring is provided, and thus the wiring having a small electric resistance value can be disposed.

The drive circuit and the wiring substrate are preferably electrically connected to each other via a bump provided in either one of the drive circuit and the wiring substrate. Consequently, even in a case where wirings connected to the drive circuit and having different heights are mixed on the wiring substrate, a wiring height variation can be absorbed by deforming the bump, and thus the drive circuit and the wirings having different heights can be reliably electrically connected to each other. A case where the wirings having different heights are mixed on the wiring substrate may include a case where the wiring which is connected to the external wiring on the wiring substrate and in which the recessed portion is formed as a result of including the buried wiring, and, for example, the wiring which is connected to the drive element and in which the recessed portion is not formed, are mixed.

The wiring and the terminal portion are preferably electrically connected to each other via a nonconductive adhesive which connects the wiring substrate and the external wiring to each other. Consequently, the wirings and the terminal portions disposed at high density can be reliably connected to each other, and thus it is possible to miniaturize the wiring substrate and an external wiring substrate on which the external wiring is provided.

The wiring and the terminal portion are preferably electrically connected to each other via an anisotropic conductive adhesive. Consequently, the wirings and the terminal portions disposed at high density can be reliably connected to each other, and thus it is possible to miniaturize the wiring substrate and an external wiring substrate on which the external wiring is provided.

Preferably, the wiring substrate is laminated on the channel formation substrate, and the wiring is provided on the wiring substrate on an opposite side to the channel formation substrate. Consequently, it is possible to easily connect the wiring of the wiring substrate to the external wiring.

Preferably, a drive element connection wiring connected to the drive element is provided on an opposite surface of the wiring substrate to the surface on which the wiring is provided, and the drive element connection wiring and the drive element are electrically connected to each other via a bump provided on either one of the channel formation substrate and the wiring substrate. Consequently, it is possible to reliably connect drive elements disposed at high density to the wirings provided on the wiring substrate via bumps at low cost.

The bump preferably includes an elastic core portion, and a metal film provided on a surface of the core portion. Consequently, even if the channel formation substrate or the wiring substrate is warped or is wavy, the bump and the drive element can be reliably connected to each other by deforming the bump.

According to another aspect of the invention, there is provided a liquid ejection apparatus comprising the liquid ejection head according to the aspect.

In this case, it is possible to realize the liquid ejection apparatus which can be stably operated by reducing an electric resistance value of a wiring and in which an external wiring can be reliably connected to the wiring.

According to still another aspect of the invention, there is provided an electronic device including a wiring substrate that is provided with a wiring connected to a terminal portion of an external wiring, in which the wiring provided on the wiring substrate includes a buried wiring buried in a groove provided in the wiring substrate, and a connection wiring covering a surface of the buried wiring, in which, in a plan view from a perpendicular direction to a surface of the wiring substrate on which the wiring is provided, the buried wiring, the connection wiring, and the terminal portion of the external wiring are formed at an overlapping position, in which a recessed portion is provided at a position corresponding to the buried wiring on a surface of the connection wiring on an opposite side to the wiring substrate, and in which, in a direction intersecting an extension direction of the wiring on the surface of the wiring substrate on which the wiring is provided, a width of the connection wiring is larger than a width of the buried wiring, a width of the terminal portion of the external wiring is larger than a width of the recessed portion, and the terminal portion is provided across the recessed portion of the connection wiring.

In this case, since the wiring substrate, the connection wiring, and the terminal portion are disposed at an overlapping position in a plan view of the wiring substrate, the buried wiring and the external wiring can be provided to be close to each other, it is possible to reduce a portion having a great electric resistance value, configured with only the connection wiring and thus to suppress a voltage drop in the middle of the wiring. Even in a case where the terminal portion of the external wiring is connected to the buried wiring at the overlapping position in order to reduce the portion of the wiring having a great electric resistance value, since the width of the terminal portion of the external wiring is larger than the width of the recessed portion, and the terminal portion is provided across the recessed portion, the terminal portion can be reliably connected to the connection wiring close to the buried wiring, and thus it is possible to suppress a voltage drop in the connection portion by suppressing a reduction in a contact area with the external wiring. Since the buried wiring is covered with the connection wiring, it is possible to suppress the occurrence of migration between wirings adjacent to each other, and also to reliably connect the wiring and the external wiring to each other. A process of removing the recessed portion of the connection wiring is not necessary, and thus it is possible to reduce cost.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail on the basis of embodiments.

Embodiment 1

The invention will be described on the basis of Embodiment 1. In the present embodiment, an ink jet type recording head (hereinafter, simply referred to as a recording head) which ejects ink as an example of a liquid ejection head will be described.

Figure 1:
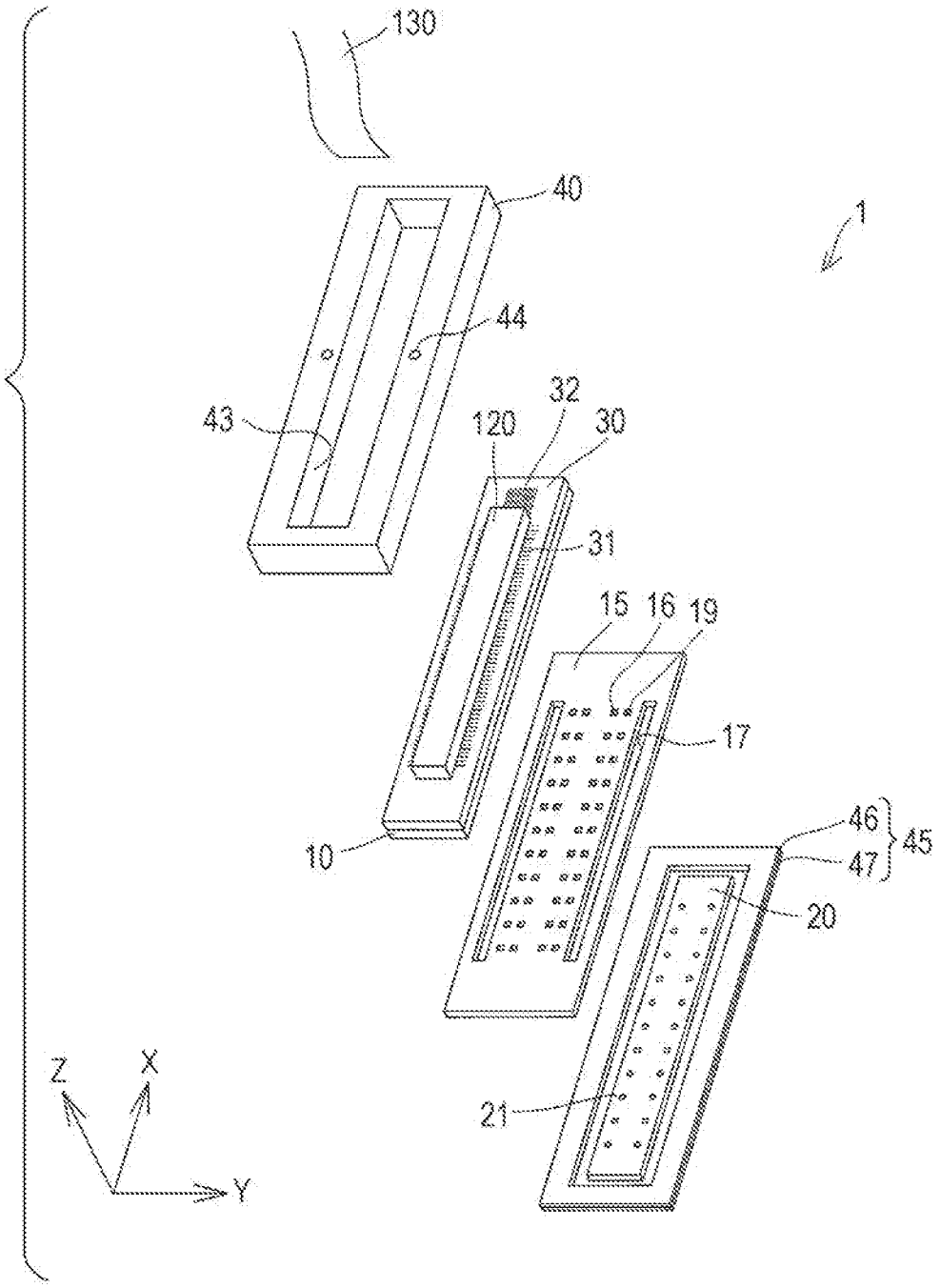
FIG. 1 is an exploded perspective view of a recording head according to Embodiment 1.
Figure 2:
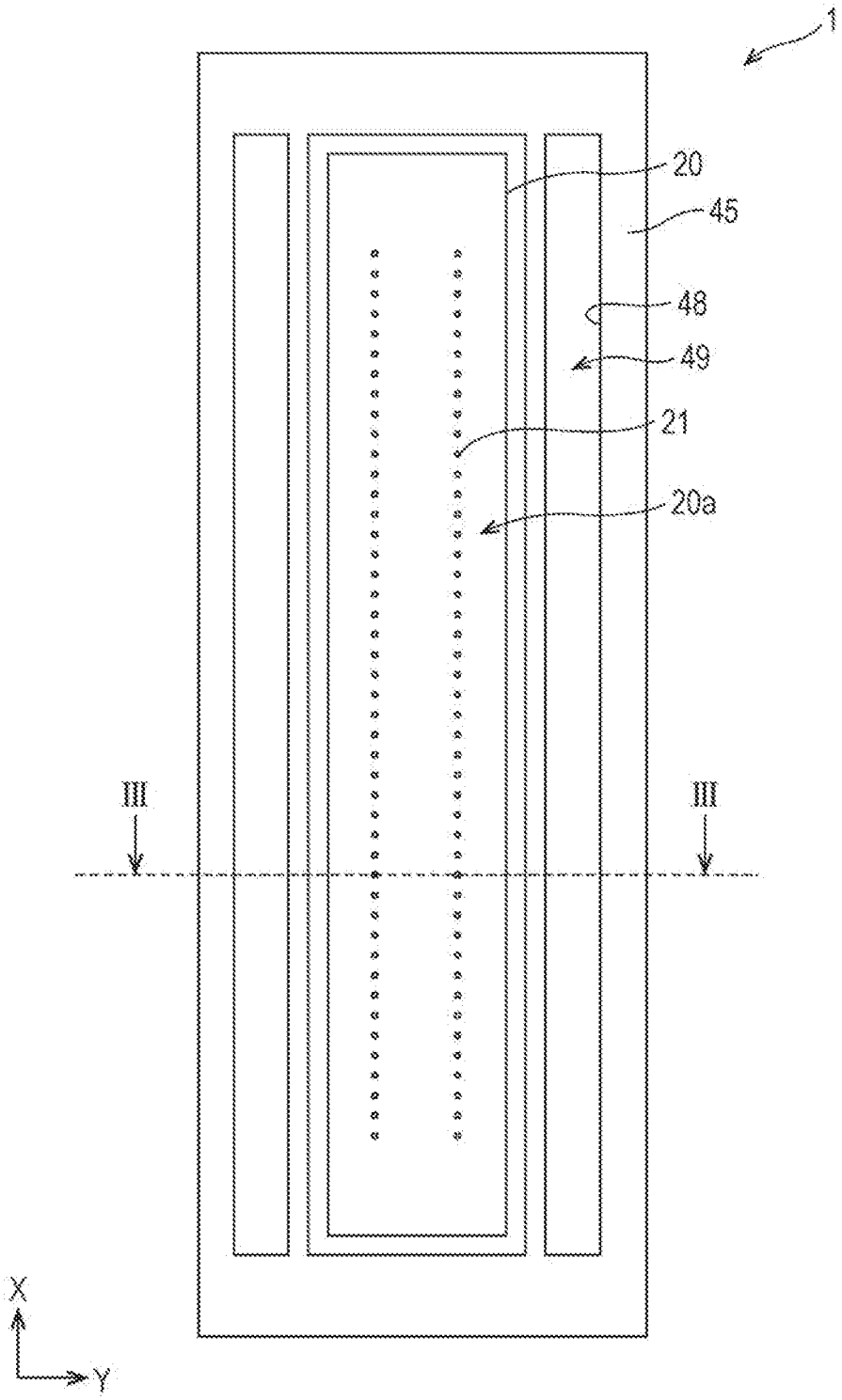
FIG. 2 is a plan view of the recording head according to Embodiment 1.
Figure 3:
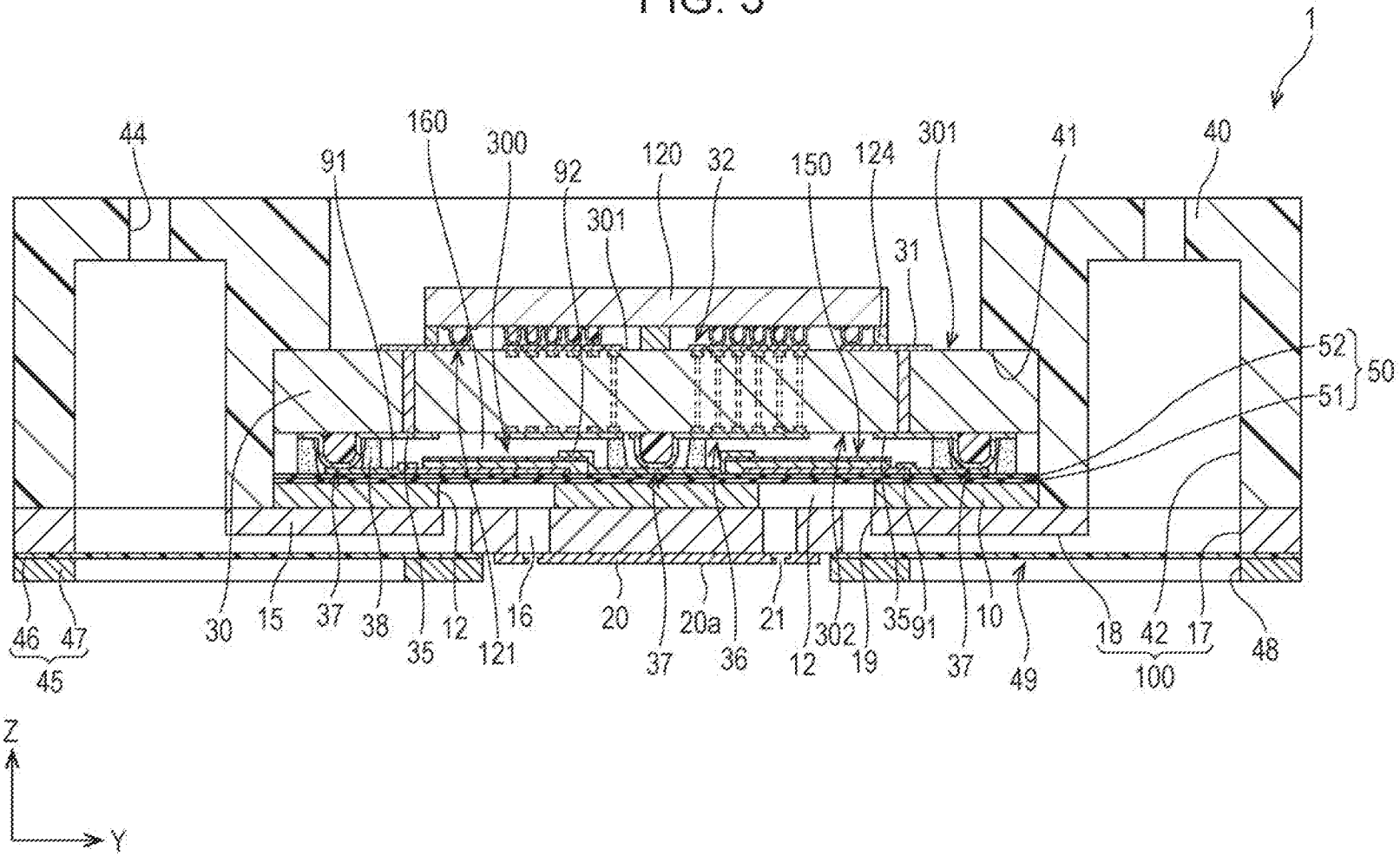
FIG. 3 is a sectional view taken along the line III-III in FIG. 2 according to Embodiment 1.
Figure 4:
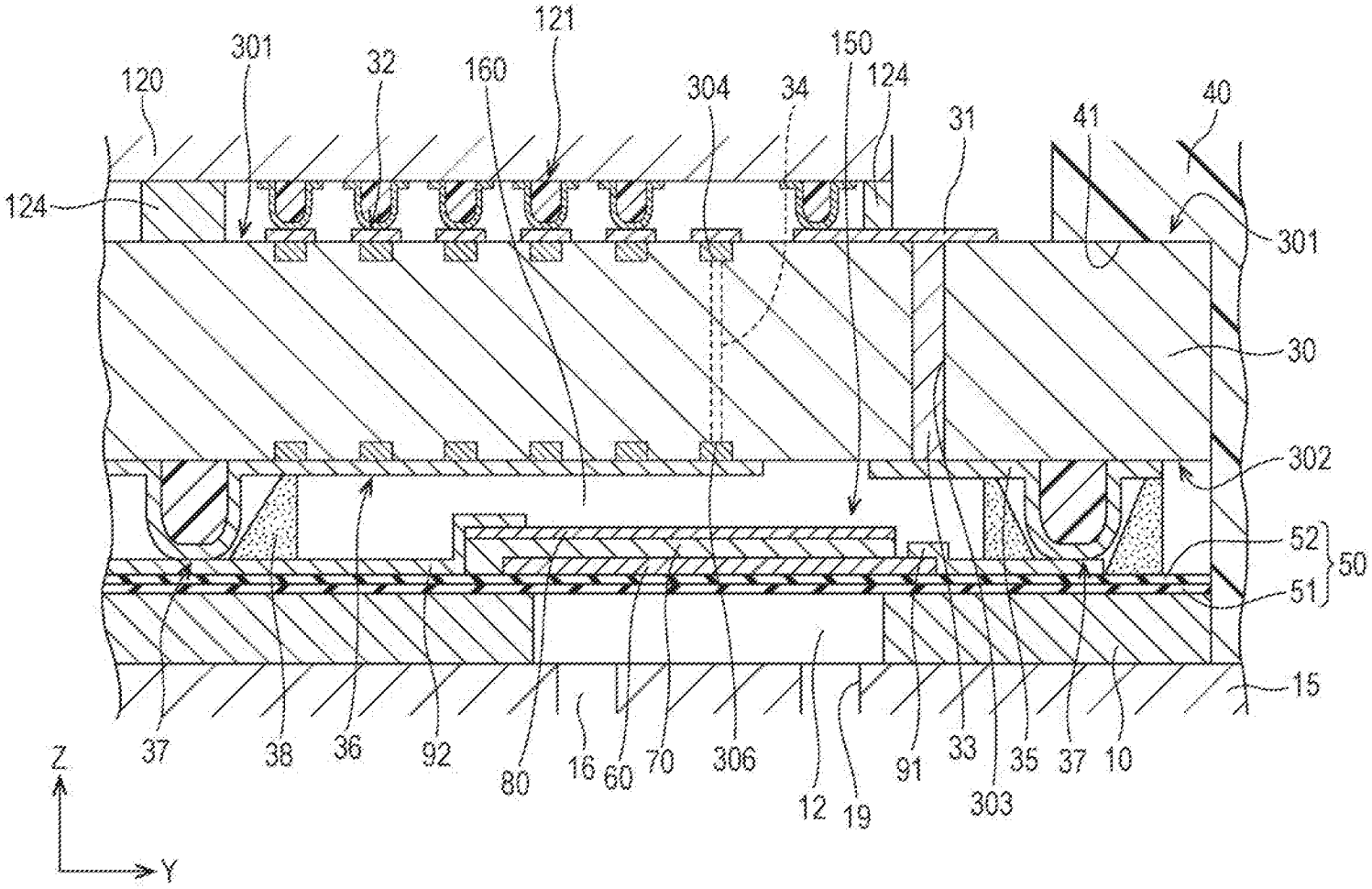
FIG. 4 is an enlarged view of principal portions in FIG. 3 according to Embodiment 1.

FIG. 1 is an exploded perspective view of a recording head according to the present embodiment, FIG. 2 is a plan view of the recording head, FIG. 3 is a sectional view taken along the line III-III in FIG. 2, and FIG. 4 is an enlarged sectional view of principal elements in FIG. 3.

As illustrated, a recording head 1 of the present embodiment includes a plurality of members such as a channel formation substrate 10, a communication plate 15, a nozzle plate 20, a drive circuit substrate 30 which is a wiring substrate of the present embodiment, and a compliance substrate 45.

The channel formation substrate 10 may employ metal such as stainless steel or Ni, a ceramic material typified by $ZrO_2$ or $Al_2O_3$, a glass ceramic material, and an oxide such as $SiO_2$, MgO, or $LaAlO_3$. In the present embodiment, the channel formation substrate 10 is made of a silicon monocrystalline substrate. In the channel formation substrate 10, pressure generation chambers 12 partitioned by a plurality of partition walls are arranged in a direction in which a plurality of nozzles 21 ejecting ink are arranged through anisotropic etching from one surface side. Hereinafter, this direction will be referred to as an arrangement direction of the pressure generation chambers 12, or a first direction X. A plurality of strings in each of which the pressure generation chambers 12 are arranged in the first direction X, for example, two strings are provided on the channel formation substrate 10 in the present embodiment. A string direction of the pressure generation chambers 12, that is, a plurality of strings of the pressure generation chambers 12 formed in the first direction X are provided will be hereinafter referred to as a second direction Y. A direction intersecting both of the first direction X and the second direction Y will be referred to as a third direction Z in the present embodiment. Coordinate axes illustrated in each drawing indicate the first direction X, the second direction Y, the third direction Z, and a direction in which an arrow is directed will be referred to as a positive (+) direction, and an opposite direction will be referred to as a negative (−) direction, in some cases. In the present embodiment, a relationship among the first direction X, the second direction Y, and the third direction Z is orthogonal, but a disposition relationship between constituent elements is not limited to being orthogonal.

The channel formation substrate 10 may be provided with a supply path of which an opening area is smaller than that of the pressure generation chamber 12 and which applies a channel resistance to ink which flows into the pressure generation chamber 12, on one end side of the pressure generation chamber 12 in the second direction Y.

The communication plate 15 and the nozzle plate 20 are sequentially stacked on a surface of the channel formation substrate 10 on an opposite side to the drive circuit substrate 30 in the −Z direction. In other words, the communication plate 15 provided on surface of the channel formation substrate 10, and the nozzle plate 20 including the nozzles 21 provided on a surface of the communication plate 15 on an opposite side to the channel formation substrate 10, are provided.

The communication plate 15 is provided with nozzle communication paths 16 via which the pressure generation chambers 12 communicates with the nozzles 21. The communication plate 15 has an area larger than that of the channel formation substrate 10, and the nozzle plate 20 has an area smaller than that of the channel formation substrate 10. Since the communication plate 15 is provided as mentioned above, the nozzle 21 of the nozzle plate 20 can be separated from the pressure generation chamber 12, ink in the pressure generation chamber 12 is hardly influenced by thickening occurring in the ink near the nozzles 21 due to evaporation of moisture in the ink. Since the nozzle plate 20 has only to cover an opening of the nozzle communication path 16 via which the pressure generation chamber 12 communicates with the nozzles 21, an area of the nozzle plate 20 can be made relatively small, and thus it is possible to reduce cost. In the present embodiment, an open surface of the nozzles 21 of the nozzle plate 20 through which ink droplets are ejected will be referred to as a liquid ejection surface 20*a*.

The communication plate 15 is provided with a first manifold portion 17 and a second manifold portion 18 configuring a part of a manifold 100.

The first manifold portion 17 is provided to penetrate through the communication plate 15 in the third direction Z which is a thickness direction. The second manifold portion 18 is provided to be open on the nozzle plate 20 side of the communication plate 15 without penetrating through the communication plate 15 in the thickness direction.

In the communication plate 15, a supply communication path 19 which communicates with one end of the pressure generation chamber 12 in the second direction Y is independently for each pressure generation chamber 12. The second manifold portion 18 communicates with the pressure generation chamber 12 via the supply communication path 19.

The communication plate 15 may employ metal such as stainless steel or Ni, or ceramics such as zirconium. The communication plate 15 is preferably made of a material having a linear expansion coefficient equivalent to that of a material of the channel formation substrate 10. In other words, in a case where the communication plate 15 is made of a material having a linear expansion coefficient which is greatly different from that of a material of the channel formation substrate 10, warping is caused by the difference between the linear expansion coefficients of the channel formation substrate 10 and the communication plate 15 during heating or cooling. In the present embodiment, the communication plate 15 is made of the same material as that of the channel formation substrate 10, that is, a silicon monocrystalline substrate, and thus it is possible to prevent the occurrence of warping due to heat, or cracks or peeling due to heat.

The nozzle plate 20 is provided with the nozzles 21 which communicates with each pressure generation chamber 12 via the nozzle communication path 16. The nozzles 21 are arranged in the first direction X, and two strings of the nozzles 21 arranged in the first direction X are formed in the second direction Y.

The nozzle plate 20 may employ, for example, metal such as stainless steel (SUS), an organic substance such as a polyimide resin, or a silicon monocrystalline substrate. In a case where the silicon monocrystalline substrate is used as the nozzle plate 20, linear expansion coefficients of the nozzle plate 20 and the communication plate 15 are equivalent to each other, and thus it is possible to prevent the occurrence of warping due to heating or cooling, or cracks or peeling due to heat.

On the other hand, a vibration plate 50 is formed on the channel formation substrate 10 on an opposite side to the communication plate 15, that is, on the drive circuit substrate 30 side in the +Z direction. In the present embodiment, the vibration plate 50 includes an elastic film 51 which is made of silicon oxide and is provided on the channel formation substrate 10 side, and an insulator film 52 which is made of zirconium oxide and is provided on the elastic film 51. A liquid channel such as the pressure generation chamber 12 is formed by performing anisotropic etching on the channel formation substrate 10 from the surface side thereof bonded to the communication plate 15, and the other surface of the liquid channel such as the pressure generation chamber 12 is partitioned by the elastic film 51. Of course, the vibration plate 50 is not particularly limited thereto, either of the elastic film 51 and the insulator film 52 may be provided, and other films may be provided.

A piezoelectric actuator 150 is provided on the vibration plate 50 of the channel formation substrate 10, as a drive element which causes a pressure change in ink in the pressure generation chamber 12 of the present embodiment. As described above, in the channel formation substrate 10, a plurality of pressure generation chambers 12 are arranged in the first direction X, and two strings of the pressure generation chambers 12 are arranged in the second direction Y. Active portions of the piezoelectric actuators 150 which are substantial drive portions are arranged in the first direction X so as to form a string, and two strings of the piezoelectric actuators 150 are arranged in the second direction Y.

The piezoelectric actuator 150 includes a first electrode 60, a piezoelectric layer 70, and a second electrode 80 which are sequentially stacked from the vibration plate 50 side. The first electrode 60 configuring the piezoelectric actuator 150 is divided for each pressure generation chamber 12, and configures an individual electrode which is independent for each active portion which is a substantial drive portion of the piezoelectric actuator 150. A material of the first electrode 60 is not particularly limited as long as the material is a conductive metal material, and, for example, a metal material such as platinum (Pt) or iridium (Ir) or a conductive oxide such as $LaNiO_3$ or $SrRuO_3$ is preferably used.

The piezoelectric layers 70 are consecutively provided in the first direction X so as to have a predetermined width in the second direction Y.

An end of the piezoelectric layer 70 at one end side (an opposite side to the manifold 100) of the pressure generation chamber 12 in the second direction Y is located further outward than an end of the first electrode 60. In other words, the end of the first electrode 60 is covered with the piezoelectric layer 70. An end of the piezoelectric layer 70 at other end side of the pressure generation chamber 12 corresponding to the manifold 100 side in the second direction Y is located further inward than an end of the first electrode 60, that is, toward the pressure generation chamber 12 side, and thus the end of the first electrode 60 on the manifold 100 side is not covered with the piezoelectric layer 70.

The piezoelectric layer 70 is made of a piezoelectric material of an oxide formed on the first electrode 60 and having a polarization structure, and may be made of a perovskite oxide represented by the general formula $ABO_3$. As the perovskite oxide used in the piezoelectric layer 70, for example, a lead-based piezoelectric material containing lead or a lead-free piezoelectric material not containing lead may be used.

Although not particularly illustrated, a recessed portion may be formed at a position corresponding to each partition wall between the pressure generation chambers 12 in the piezoelectric layer 70. Consequently, the piezoelectric actuator 150 can be favorably displaced.

The second electrode 80 is provided on a surface of the piezoelectric layer 70 on an opposite side to the first electrode 60, and configures a common electrode common to a plurality of active portions.

The piezoelectric actuator 150 configured with the first electrode 60, the piezoelectric layer 70, and the second electrode 80 is displaced as a result of applying a voltage between the first electrode 60 and the second electrode 80. In other words, piezoelectric distortion occurs in the piezoelectric layer 70 interposed between the first electrode 60 and the second electrode 80 as a result of applying a voltage between both of the electrodes. A portion of which piezoelectric distortion occurs in the piezoelectric layer 70 when a voltage is applied between both of the electrodes, that is, a region interposed between the first electrode 60 and the second electrode 80 will be referred to as an active portion.

In contrast, a portion of which piezoelectric distortion does not occur in the piezoelectric layer 70 will be referred to as an inactive portion. A portion of the piezoelectric actuator 150 which faces the pressure generation chamber 12 and is variable will be referred to as a flexible portion, and a portion outside the pressure generation chamber 12 will be referred to as a non-flexible portion.

As described above, in the piezoelectric actuator 150, the first electrode 60 is provided separately for each of a plurality of active portions so as to be used as an individual electrode, and the second electrode 80 is consecutively provided over the plurality of active portions so as to be used as a common electrode. Of course, there is no limit to such an aspect, the first electrode 60 may be consecutively provided over the plurality of active portions so as to be used as a common electrode, and the second electrode 80 may be provided separately for each of a plurality of active portions so as to be used as an individual electrode. As the vibration plate 50, only the first electrode 60 may function as a vibration plate without providing the elastic film 51 and the insulator film 52. The piezoelectric actuator 150 may be also substantially used as a vibration plate. In the present embodiment, the active portions of the piezoelectric actuators 150 are arranged in the first direction X in correspondence to the pressure generation chambers 12, and two strings of the active portions arranged in the first direction X as mentioned above are arranged in the second direction Y.

As illustrated in FIGS. 3 and 4, an individual lead electrode 91 which is a lead wiring is led from the first electrode 60 of the piezoelectric actuator 150. The individual lead electrode 91 is led outward of the string in the second direction Y from the active portion of each string.

A common lead electrode 92 which is a lead wiring is led from the second electrode 80 of the piezoelectric actuator 150. In the present embodiment, the common lead electrode 92 is electrically connected to the second electrode 80 of each of the piezoelectric actuators 150 of two strings. A single common lead electrode 92 is provided for a plurality of active portions.

Figure 5:
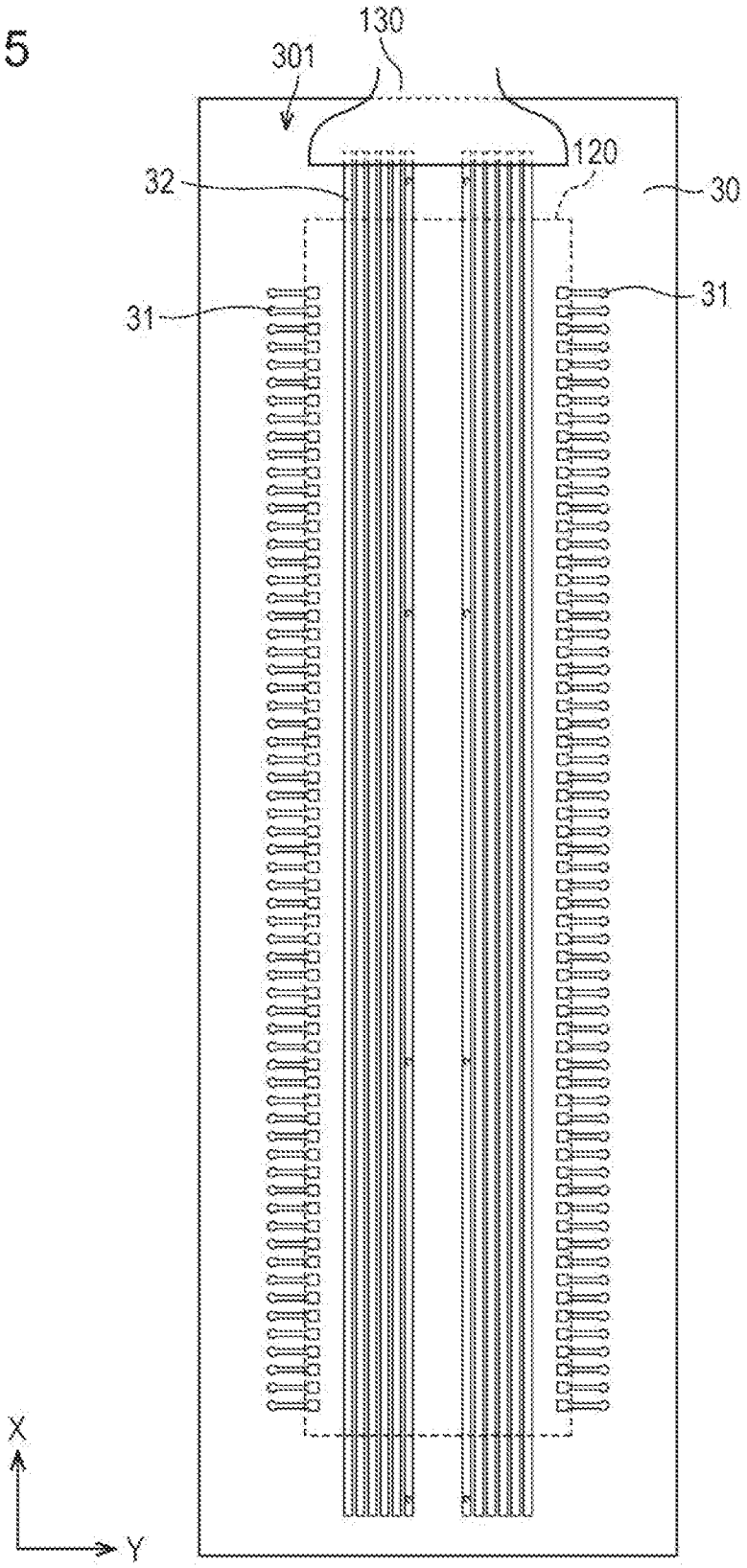
FIG. 5 is a plan view of a drive circuit substrate according to Embodiment 1.
Figure 8:
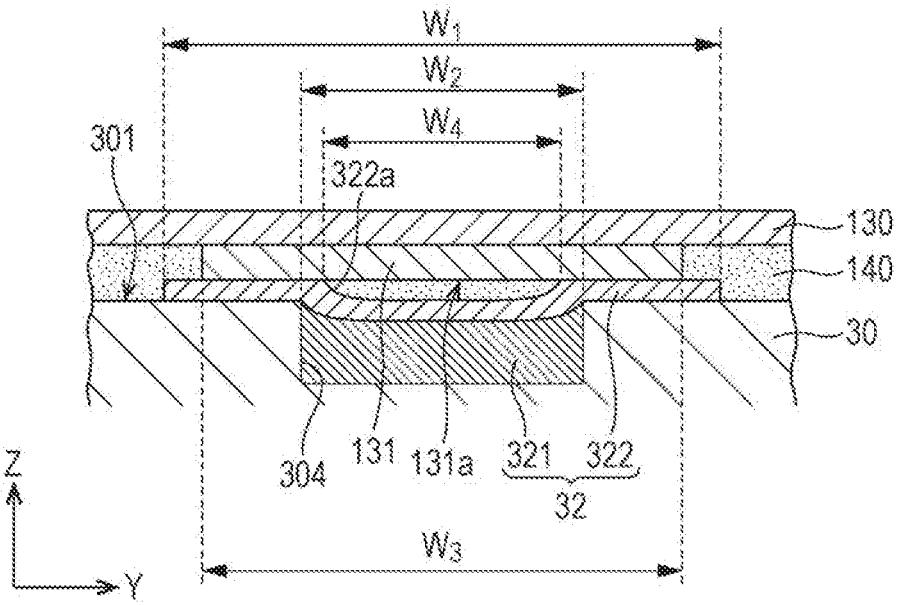
FIG. 8 is a sectional view taken along the line VIII-VIII in FIG. 6 according to Embodiment 1.
Figure 9:
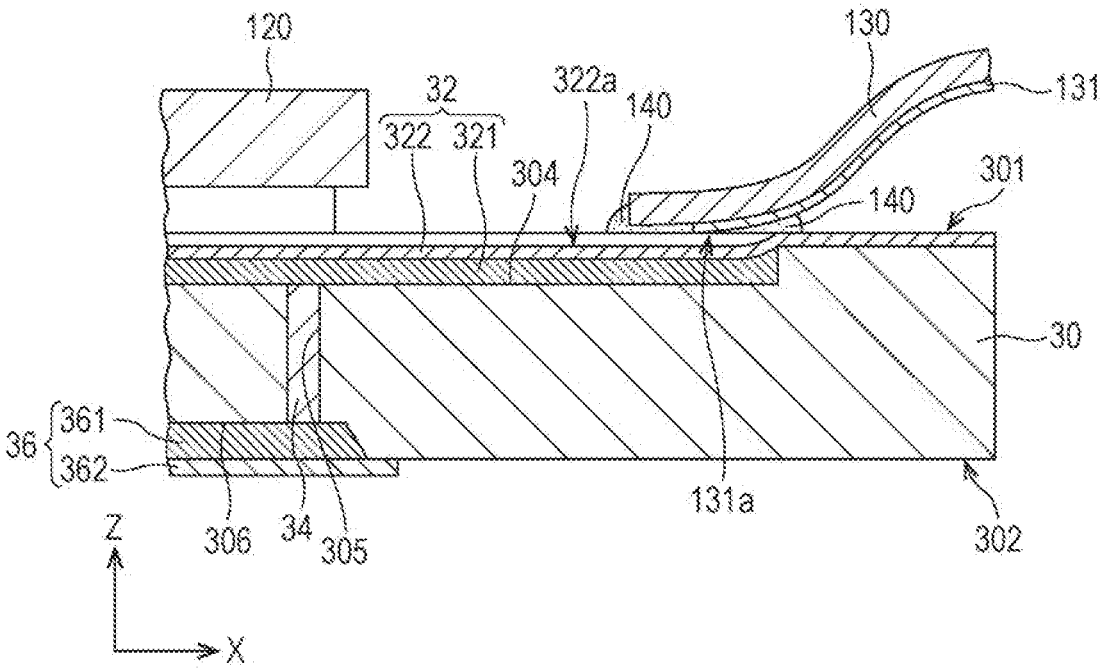
FIG. 9 is a sectional view taken along the line IX-IX in FIG. 6 according to Embodiment 1.
Figure 10:
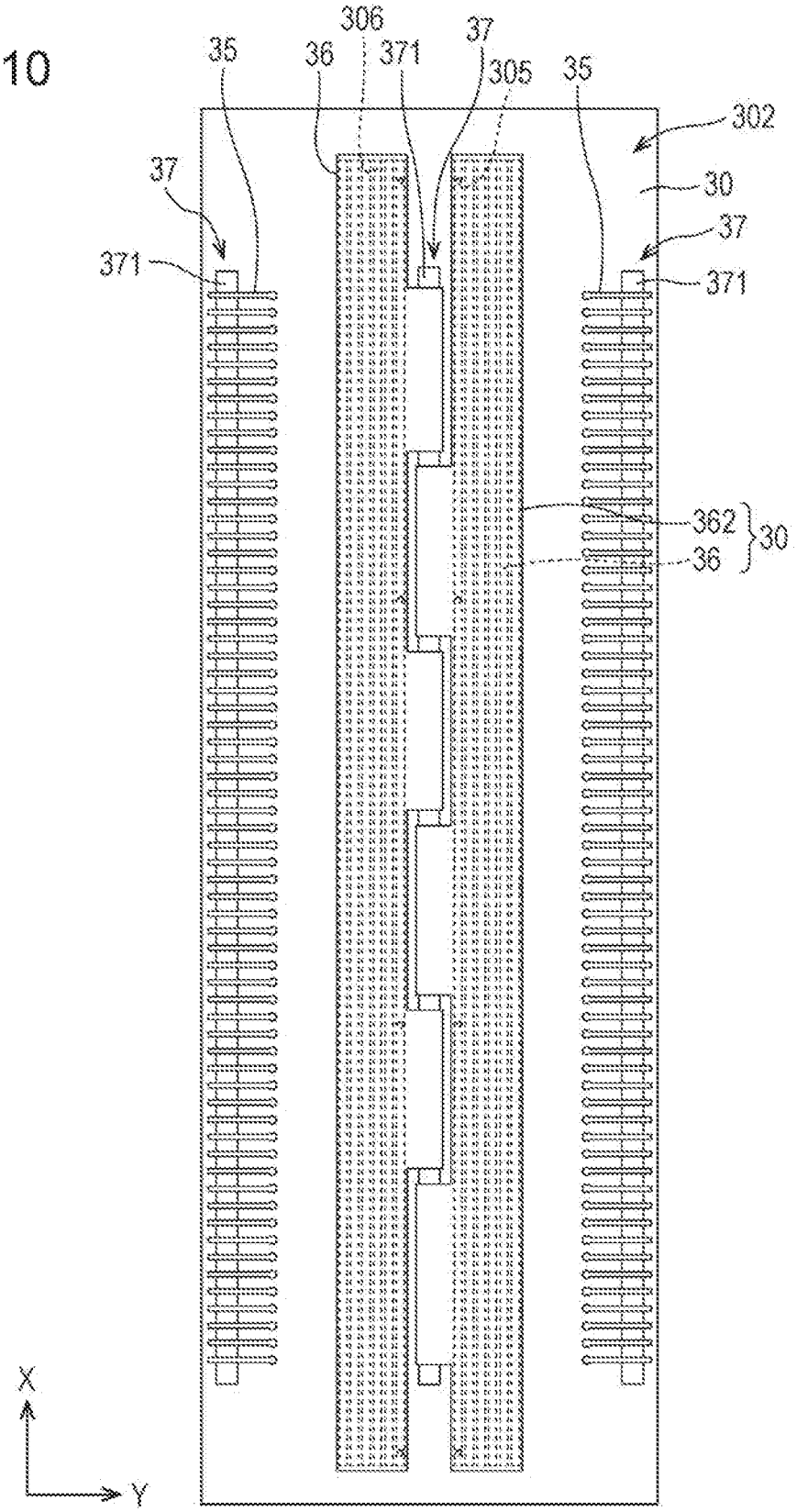
FIG. 10 is a bottom view of the drive circuit substrate according to Embodiment 1.
Figure 11:
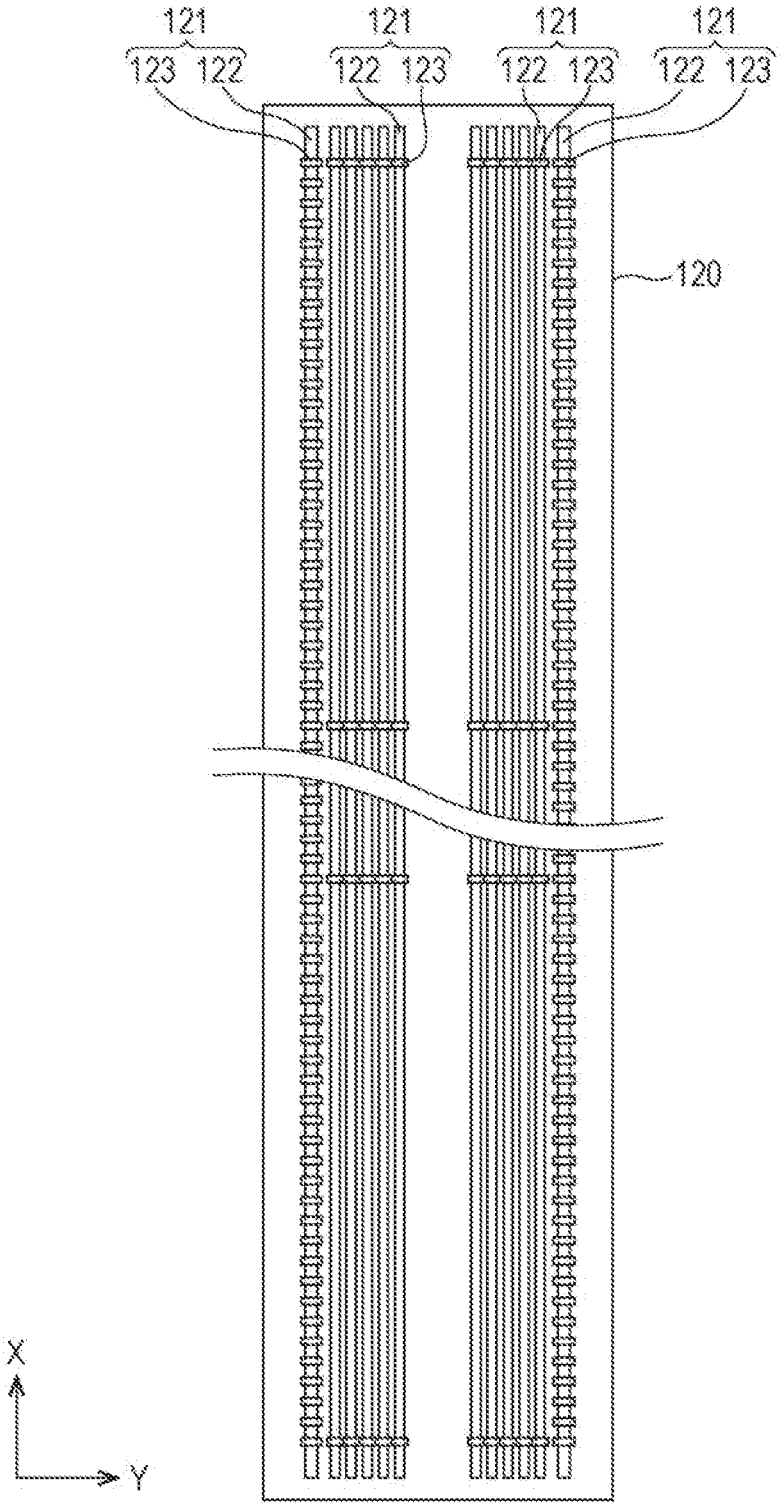
FIG. 11 is a bottom view of a drive circuit according to Embodiment 1.

The drive circuit substrate 30 which is a wiring substrate of the present embodiment is bonded to the surface of the channel formation substrate 10 on the piezoelectric actuator 150 side. The drive circuit substrate 30 has the substantially same size as that of the channel formation substrate 10. Here, the drive circuit substrate 30 of the present embodiment will be described in detail with reference to FIGS. 5 to 11. FIG. 5 is a plan view of the drive circuit substrate viewed from the +Z side, FIG. 6 is an enlarged view of principal elements in FIG. 5, FIG. 7 is an enlarged view of principal elements in FIG. 4, FIG. 8 is a sectional view taken along the line VIII-VIII in FIG. 6, FIG. 9 is a sectional view taken along the line IX-IX in FIG. 6, FIG. 10 is a bottom view of the drive circuit substrate, and FIG. 11 is a drive circuit substrate of a drive circuit.

The drive circuit substrate 30 may employ metal such as stainless steel or Ni, a ceramic material typified by $ZrO_2$ or $Al_2O_3$, a glass ceramic material, and an oxide such as $SiO_2$, MgO, or $LaAlO_3$. In the present embodiment, a silicon monocrystalline substrate is used. In the present embodiment, a surface of the drive circuit substrate 30 which is a surface on the +Z side as an opposite side to the channel formation substrate 10 will be referred to as a first principal surface 301, and a surface on the −Z side as the channel formation substrate 10 side will be referred to as a second principal surface 302.

Figure 6:
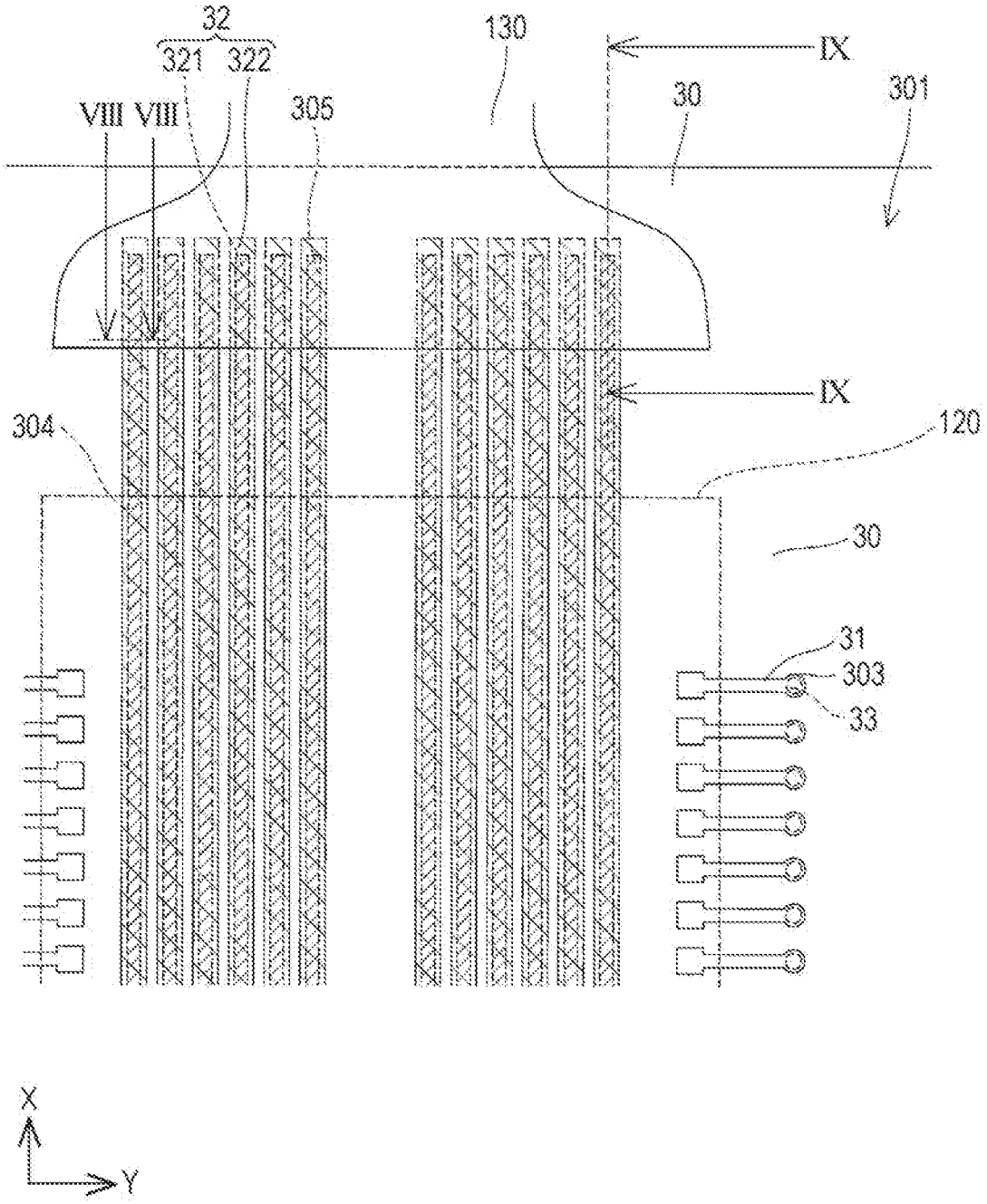
FIG. 6 is an enlarged plan view of principal elements of the drive circuit substrate according to Embodiment 1.
Figure 7:
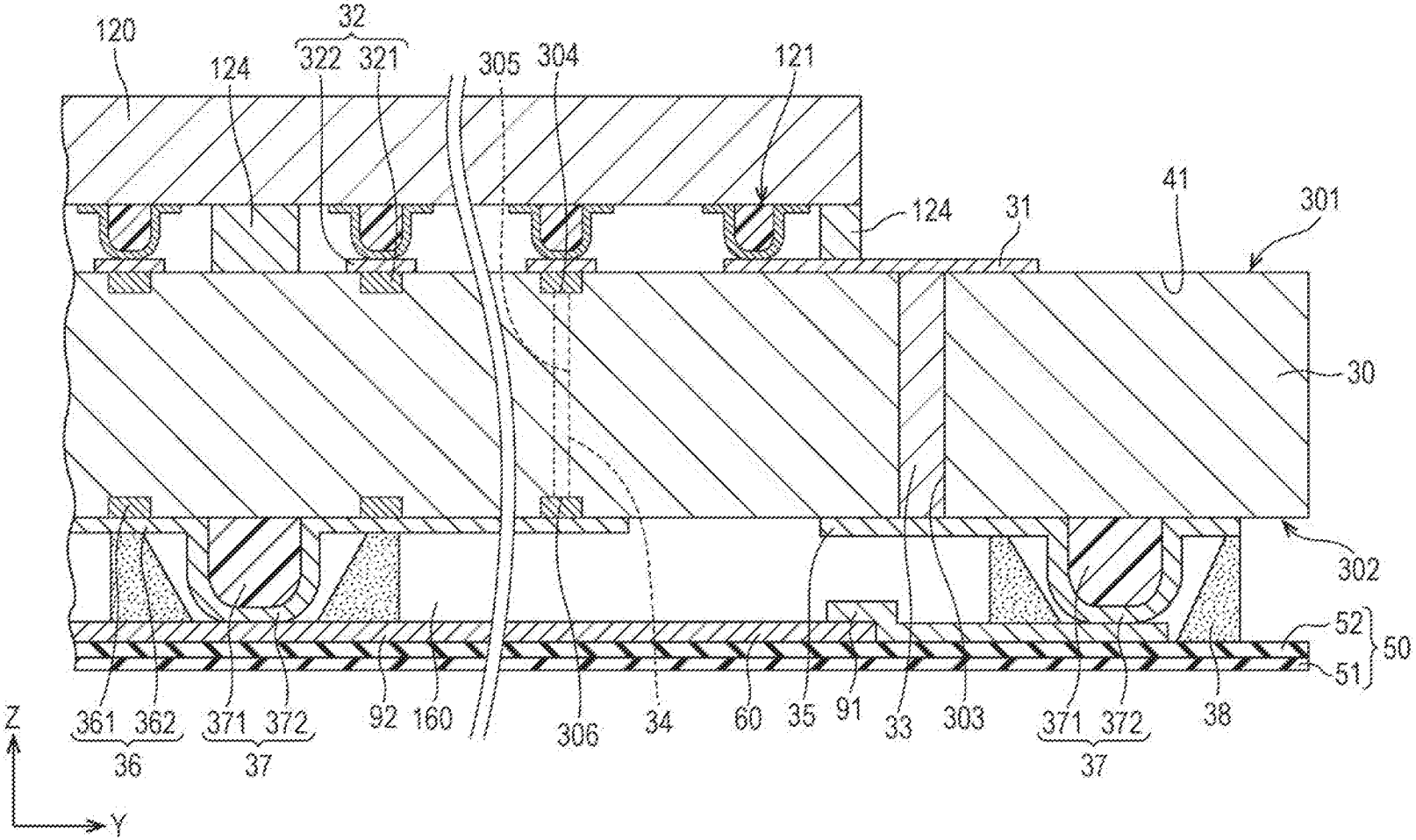
FIG. 7 is an enlarged view of principal elements in FIG. 4 according to Embodiment 1.

As illustrated in FIGS. 6 and 7, a drive circuit 120 which outputs an ejection drive signal for driving the piezoelectric actuator 150 is mounted on the first principal surface 301 of the drive circuit substrate 30. For example, the drive circuit 120 includes a switching element such as a transmission gate provided for each piezoelectric actuator 150, and generates an ejection drive signal for driving the piezoelectric actuator 150 at a desired timing by opening and closing the switching element on the basis of a control signal which is input via an external wiring 131. In the present embodiment, the drive circuit 120 is mounted on the first principal surface 301 of the drive circuit substrate 30, but is not particularly limited thereto, and the drive circuit 120 may be mounted on the second principal surface 302 of the drive circuit substrate 30, and the drive circuit 120 may be provided integrally with the drive circuit substrate 30.

The drive circuit substrate 30 is provided to be long in the first direction X which is an arrangement direction of the active portions of each string of the piezoelectric actuators 150. In other words, the drive circuit substrate 30 is disposed such that the first direction X is a longitudinal direction, and the second direction Y is a short direction.

As illustrated in FIGS. 5, 6, and 7, first individual wirings 31 and supply wirings 32 are provided on the first principal surface 301 of the drive circuit substrate 30. The supply wiring 32 of the present embodiment corresponds to a wiring disclosed in the claims.

A plurality of first individual wirings 31 are arranged in the first direction X in each of both ends in the second direction Y. The first individual wiring 31, which extends in the second direction Y, has one end electrically connected to each terminal of the drive circuit 120, and the other end electrically connected to a first through-wire 33.

Here, the first through-wire 33 is provided inside a first through-hole 303 which is provided to penetrate through the drive circuit substrate 30 in the third direction Z which is a thickness direction, and is a wire relaying the first principal surface 301 to the second principal surface 302. The first through-hole 303 in which the first through-wire 33 is provided may be formed by performing laser processing, drilling, dry etching (a Bosch method, a non-Bosch method, or ion milling), inductively coupled plasma (ICP) processing, wet etching, or sand blast etching on the drive circuit substrate 30. The first through-wire 33 is formed to fill the first through-hole 303. The first through-wire 33 is made of metal such as copper (Cu), and may be formed through electrolytic plating or electroless plating.

The first through-wire 33 is electrically connected to the individual lead electrode 91 connected to the first electrode 60 which is an individual electrode of the piezoelectric actuator 150 on the second principal surface 302. In other words, the first individual wirings 31 and the first through-wires 33 are provided in the same number as the number of first electrodes 60 of the piezoelectric actuators 150. The first individual wirings 31 may be formed according to, for example, a sputtering method.

The supply wiring 32 is used to supply a power source potential (VDD), a ground potential (GND), a high power source potential (VHV), and control signals (for example, a clock signal CLK, a latch signal LAT, a change signal CH, and a setting signal TD) for the drive circuit 120 to the drive circuit 120 from the external wiring 131 of an external wiring substrate 130, and to supply a drive signal (COM), a bias voltage (vbs), and the like to the piezoelectric actuator 150, and is provided on the first principal surface 301 of the drive circuit substrate 30 in a plurality. In the present embodiment, the supply wiring 32 extends linearly in the first direction X, and the plurality of supply wirings 32 are arranged in the second direction Y.

As illustrated in FIGS. 8 and 9, the supply wiring 32 includes a first buried wiring 321 which is a buried wiring buried in a first groove 304 which is provided on the first principal surface 301, and a first connection wiring 322 which is a connection wiring of the present embodiment provided to cover the first buried wiring 321.

Here, the first groove 304 in which the first buried wiring 321 is provided may be formed with high accuracy by performing, for example, anisotropic etching (wet etching) using an alkali solution. The first groove 304 extends linearly in the first direction X. A method of forming the first groove 304 is not limited to anisotropic etching, and may be dry etching or mechanical processing.

The first groove 304 formed as mentioned above has a rectangular shape as a cross section in the second direction Y. As illustrated in FIG. 6, a plurality of first grooves 304 are provided in the second direction Y, and, in the present embodiment, six first grooves 304 for each string of the active portions of the piezoelectric actuators 150, that is, a total of twelve first grooves 304 are provided. Of course, the number and positions of the first grooves 304 are not particularly limited thereto, and the number of each of the first grooves 304 and the supply wirings 32 may be one, and may be two or more.

As illustrated in FIGS. 8 and 9, the first buried wiring 321 is buried in the first groove 304. In other words, the first buried wiring 321 is formed to fill the first groove 304. The first buried wiring 321 is made of metal such as copper (Cu), and may be formed according to, for example, electrolytic plating, electroless plating, or conductive paste printing. The first buried wiring 321 may be formed together with the first through-wire 33 through plating. As mentioned above, the first buried wiring 321 and the first through-wire 33 are simultaneously formed, and thus it is possible to reduce cost by simplifying manufacturing processes.

A surface of the first buried wiring 321 buried in the first groove 304 is disposed at a position lower than a surface of the drive circuit substrate 30 to which the first groove 304 is open. In the present embodiment, the surface of the first buried wiring 321 is a curve surface of which a central part side is recessed most, that is, a so-called recessed curve surface. The recessed curve surface is formed, for example, by forming the first buried wiring 321 in the first groove 304 and on the surface of the drive circuit substrate 30, and then simultaneously removing a part of the first buried wiring 321 on the surface side of the drive circuit substrate 30, provided in the first groove 304 when a residual first buried wiring 321 formed on the surface of the drive circuit substrate 30 is removed. Removal of the residual first buried wiring 321 on the surface of the drive circuit substrate 30 may be performed by using, for example, dry etching such as ion milling, blast processing typified by sand blast, mechanical processing such as chemical mechanical polishing (CMP), or wet etching. The first buried wiring 321 having a surface such as a recessed curve surface as in the present embodiment is formed by using, for example, CMP. Of course, the surface of the first buried wiring 321 may be formed to be recessed more than the surface of the drive circuit substrate 30 according to other methods. There is no limit to a method of forming a recess by removing a part of the formed first buried wiring 321, and, when the first buried wiring 321 is formed, a film may be formed in the middle of the first groove 304 in a depth direction, that is, only on a bottom surface side.

The first connection wiring 322 corresponds to a connection wiring disclosed in the claims, and is laminated to cover the surface of each first buried wiring 321. A width $W_1$ of the first connection wiring 322 in the second direction Y intersecting the first direction X which is an extension direction thereof is larger than a width $W_2$ of the first buried wiring 321 in the second direction Y. In other words, the first connection wiring 322 is continuously provided over the first principal surface 301 of the drive circuit substrate 30 and the surface of the first buried wiring 321 which has the surface recessed more than the first principal surface 301 of the drive circuit substrate 30. Since the first connection wiring 322 is formed at a substantially identical thickness, a recessed portion 322*a* is provided on the first buried wiring 321 on a surface of the first connection wiring 322 on an opposite side to the drive circuit substrate 30. The surface of the first buried wiring 321 is recessed into a recessed curve surface, and thus an inner surface of the recessed portion 322*a* is also formed to be a recessed curve surface. Since the first connection wiring 322 is formed at a substantially identical thickness in the second direction Y, a width $W_4$ of the recessed portion 322*a* provided on the surface of the first connection wiring 322 is smaller than the width $W_2$ of the first buried wiring 321. The width of the recessed portion 322*a* is a width between corners of an opening of the recessed portion 322*a*.

In the present embodiment, the first connection wirings 322 are provided with a gap at the width $W_1$ such that the first connection wirings 322 adjacent to each other in the second direction Y are not short-circuited to each other. In other words, a single supply wiring 32 of the present embodiment is configured with a single first buried wiring 321 and a single first connection wiring 322.

Although not particularly illustrated, a laminate of an adhesion layer provided on the first buried wiring 321 side, such as titanium (Ti), a titanium tungsten compound (TiW), nickel (Ni), chromium (Cr), or a nickel chromium compound (NiCr), and a conductive layer provided on the adhesion layer, such as gold (Au) or platinum (Pt) may be used as the first buried wiring 321. Of course, layers made of other conductive materials may be laminated. The first connection wiring 322 may be formed according to, for example, a sputtering method. The first connection wiring 322 may be simultaneously formed with, for example, the first individual wiring 31. As mentioned above, the first connection wiring 322 is formed together with the first individual wiring 31, and thus it is possible to reduce cost by simplifying manufacturing processes.

As mentioned above, since the width $W_1$ of the first connection wiring 322 is larger than the width $W_2$ of the first buried wiring 321, and the first buried wiring 321 is completely covered with the first connection wiring 322 so as not to be exposed, it is possible to prevent the occurrence of so-called migration that the adjacent supply wirings 32 are short-circuited to each other due to exposure of the first buried wiring 321.

The supply wiring 32 including the first buried wiring 321 and the first connection wiring 322 is electrically connected to the external wiring 131 of the external wiring substrate 130. Here, in the present embodiment, the external wiring substrate 130 is a flexible substrate or cable such as a flexible flat cable (FFC) or a flexible printed circuit (FPC). The external wiring substrate 130 is not limited to a flexible substrate or cable, and may be a rigid substrate, and may be a flexible rigid substrate.

The external wiring substrate 130 is provided with a plurality of external wirings 131 used to supply a power source potential (VDD), a ground potential (GND), a high power source potential (VHV), and control signals (for example, a clock signal CLK, a latch signal LAT, a change signal CH, and a setting signal TD) for the drive circuit 120, and to supply a drive signal (COM), a bias voltage (vbs), and the like to the piezoelectric actuator 150. A terminal portion 131*a* of the external wiring 131 provided on the external wiring substrate 130 is electrically connected to the supply wiring 32 of the drive circuit substrate 30.

Here, in a plan view from the third direction Z which is a perpendicular direction to the surface of the drive circuit substrate 30 on which the supply wiring 32 is provided, the first buried wiring 321, the first connection wiring 322, and the terminal portion 131*a* are provided at an overlapping position. In other words, the first buried wiring 321 is formed under the first connection wiring 322 connected to the terminal portion 131*a* of the external wiring 131 in the third direction Z. In a case where the first buried wiring 321, the first connection wiring 322, and the terminal portion 131*a* are provided at an overlapping position in a plan view from the third direction Z, at least parts of the first buried wiring 321, the first connection wiring 322, and the terminal portion 131*a* may overlap each other. In other words, in the present embodiment, the first buried wiring 321 and the first connection wiring 322 extends further toward both sides in the first direction X than the terminal portion 131*a*.

As mentioned above, since the first buried wiring 321 is provided in a connection portion between the terminal portion 131*a* and the first connection wiring 322, a portion having a great electric resistance value is reduced in the middle of the supply wiring 32 used to supply a power source voltage, a ground voltage, a drive signal, and a bias voltage to the drive circuit 120 or the piezoelectric actuator 150 from the external wiring 131, and thus it is possible to prevent a voltage drop. In other words, in a case where the first buried wiring 321 is not provided in a connection portion between the terminal portion 131*a* and the first connection wiring 322, a portion where a power source voltage or a drive signal is supplied via only the first connection wiring 322 is formed to be long between the first buried wiring 321 and the terminal portion 131*a*, so that an electric resistance value of a portion configured with only the first connection wiring 322 of the supply wiring 32 is increased, and thus a voltage drop occurs. In the present embodiment, since a portion configured with only the first connection wiring 322 of the supply wiring 32 can be reduced as much as possible from a portion connected to the external wiring substrate 130 to a portion connected to a second through-wire 34 or the drive circuit 120, the occurrence of a portion having a great electric resistance value is reduced in the supply wiring 32 such that an electric resistance value of the supply wiring 32 can be reduced, and thus it is possible to prevent supply defects due to a voltage drop of a power source voltage or a drive signal. Therefore, it is possible to prevent supply defects of a power source voltage, a ground voltage, a drive signal, or a bias voltage due to a voltage drop in the supply wiring 32, and thus to prevent the occurrence of a delay when the piezoelectric actuator 150 which is a drive element is driven at a high frequency.

In a direction intersecting the first direction X which is an extension direction of the first buried wiring 321 in the surface of the drive circuit substrate 30 on which the supply wiring 32 is provided, that is, in the second direction Y, the width $W_1$ of the first connection wiring 322 is larger than the width $W_2$ of the first buried wiring 321, and the width $W_3$ of the terminal portion 131*a* is larger than the width $W_4$ of the recessed portion 322*a* of the first connection wiring 322. In other words, a relationship of $W_1>W_2$ and $W_3>W_4$ is satisfied. In the present embodiment, in the second direction Y, the width $W_3$ of the terminal portion 131*a* is smaller than the width $W_1$ of the first connection wiring 322.

In the second direction Y, the terminal portion 131*a* is provided across the recessed portion 322*a* of the first connection wiring 322. Here, the terminal portion 131*a* being provided across the recessed portion 322*a* of the first connection wiring 322 in the second direction Y indicates that, in the third direction Z, the terminal portion 131*a* is provided to face portions on both sides of the recessed portion 322*a* of the first connection wiring 322 in the second direction Y, and portions facing portions of the terminal portion 131*a* on both sides of the recessed portion 322*a* in the second direction Y are continuously provided. In other words, the terminal portion 131*a* is continuously provided from the portion on one side to the portion on the other side in the second direction Y more than the recessed portion 322*a* of the first connection wiring 322. The terminal portion 131*a* is preferably provided across the recessed portion 322*a* without contacting the bottom surface of the recessed portion 322*a*. Thus, it is possible to prevent deformation of the terminal portion 131*a* due to contact with the bottom surface of the recessed portion 322*a*, and thus to prevent cracking, chipping, or the like of the terminal portion 131*a* due to the deformation of the terminal portion 131*a*.

As mentioned above, since the width $W_3$ of the terminal portion 131*a* is larger than the width $W_4$ of the recessed portion 322*a* of the first connection wiring 322, and the terminal portion 131*a* is provided across both sides of the recessed portion 322*a* of the first connection wiring 322, the terminal portion 131*a* can be electrically connected to the portions on both sides of the recessed portion 322*a* in the second direction Y where the recessed portion 322*a* of the first connection wiring 322 is not provided, that is, the portions of the first connection wiring 322 provided on the first principal surface 301 of the drive circuit substrate 30. In other words, in order to reduce a portion having a great electric resistance value in the supply wiring 32, the first buried wiring 321 is formed up to the portion of the supply wiring 32 connected to the terminal portion 131*a* of the external wiring 131, and, thus, even if the recessed portion 322*a* is formed on the surface of the first connection wiring 322, the terminal portion 131*a* can be electrically connected to the first connection wiring 322 provided outside the first buried wiring 321 such that a contact area can be secured. In other words, in a case where the first buried wiring 321 is not provided in the region where the terminal portion 131*a* is formed, the first connection wiring 322 is formed on the surface of the drive circuit substrate 30, and thus the surface of the first connection wiring 322 is a flat surface without the recessed portion 322*a*. The flat surface is easily connected to the terminal portion 131*a*, but the supply wiring 32 has a portion configured with only the first connection wiring 322 between a portion connected to the terminal portion 131*a* and a portion where the first buried wiring 321 is provided, and thus an electric resistance value of the supply wiring 32 is increased. In the present embodiment, since the first buried wiring 321 extends to the portion connected to the terminal portion 131*a* in the first direction X, even if the recessed portion 322*a* is formed on the surface of the first connection wiring 322 connected to the terminal portion 131*a*, the width $W_3$ of the terminal portion 131*a* is larger than the width $W_4$ of the recessed portion 322*a*, and thus the terminal portion 131*a* can be reliably connected to the vicinity of the recessed portion 322*a* of the first connection wiring 322, that is, the vicinity of the first buried wiring 321.

In the second direction Y, the width $W_2$ of the first buried wiring 321 is larger than the width $W_4$ of the recessed portion 322*a* of the first connection wiring 322. Therefore, the width $W_3$ of the terminal portion 131*a* is preferably larger than the width $W_2$ of the first buried wiring 321. In other words, a relationship of $W_3>W_2$ is preferably satisfied. Consequently, the terminal portion 131*a* can be reliably connected on both sides of the region where the recessed portion 322*a* of the first connection wiring 322 is formed. The width $W_4$ of the recessed portion 322*a* of the first connection wiring 322 is larger than the width $W_2$ of the first buried wiring 321. However, it may be necessary to perform processing for increasing a width of the recessed portion 322*a* of the first connection wiring 322. In other words, the first connection wiring 322 having the width $W_4$ smaller than the width $W_2$ of the first buried wiring 321 in the second direction Y can be easily formed only by forming films at a substantially identical thickness without performing special processing. There may be a method in which the first connection wiring 322 is formed thick, and then the recessed portion 322*a* is removed by polishing the surface of the first connection wiring 322 according to CMP or the like, but the number of materials or processes is increased, and thus cost is increased. In the present embodiment, the terminal portion 131*a* can be reliably electrically and mechanically connected to the supply wiring 32 without removing the recessed portion 322*a* of the first connection wiring 322, and thus it is possible to reduce cost.

In the present embodiment, the terminal portion 131*a* of the external wiring 131 is connected to the supply wiring 32 via a nonconductive adhesive (NCP or NCF) 140. In other words, the nonconductive adhesive 140 is provided around the region where the terminal portion 131*a* is in contact with the supply wiring 32, and maintains the contact state between the terminal portion 131*a* and the supply wiring 32 so as to electrically connect the terminal portion 131*a* to the supply wiring 32 as a result of adhering the drive circuit substrate 30 to the external wiring substrate 130. The supply wiring 32 is connected to the external wiring 131 via the nonconductive adhesive 140 as mentioned above, and thus the supply wiring 32 and the external wiring 131 can be reliably connected to each other even if the supply wirings 32 and the external wirings 131 are disposed in the second direction Y at high density. Therefore, it is possible to reduce a space for providing the supply wiring 32 on the drive circuit substrate 30, and thus to achieve miniaturization of the drive circuit substrate 30, particularly, in the second direction Y which is an arrangement direction of the supply wirings 32. It is possible to reduce a space for providing the external wiring 131 on the external wiring substrate 130, and thus to achieve miniaturization of the external wiring substrate 130, particularly, in the second direction Y which is an arrangement direction of the external wirings 131.

Here, at least one of the six supply wirings 32 provided to correspond to each string the active portions of the piezoelectric actuators 150 is not connected to the drive circuit 120 and is electrically connected to the second electrode 80 which is a common electrode of the piezoelectric actuators 150, and is used to directly supply the bias voltage (vbs) to the second electrode 80 of the piezoelectric actuator 150 from the external wiring substrate 130. The other supply wirings 32 of the six supply wirings 32 provided for each string of the active portions of the piezoelectric actuators 150 are electrically connected to the drive circuit 120, and are used to supply a power source voltage for a high voltage circuit or a low voltage circuit of the drive circuit 120, the ground voltage (GND), the drive signal (COM), a control signal for the drive circuit 120, and the like to the drive circuit 120 from the external wirings 131.

In the present embodiment, among the six supply wirings 32 provided for each string of the active portions of the piezoelectric actuators 150, the supply wiring 32 provided on the center side of the drive circuit substrate 30 in the second direction Y is used to supply the bias voltage (vbs) to the second electrode 80 of the piezoelectric actuator 150. The supply wiring 32 used to supply the bias voltage to the second electrode 80 of the piezoelectric actuator 150 is electrically connected to the second through-wire 34 provided in the drive circuit substrate 30.

As illustrated in FIG. 9, the second through-wire 34 is formed in a second through-hole 305 provided to be open to the bottom surface of the first groove 304. Consequently, the second through-wire 34 and the supply wiring 32 are electrically connected to each other on the bottom surface of the first groove 304. In the same manner as the first through-wire 33, the second through-wire 34 may be formed through electrolytic plating or electroless plating by using metal such as copper (Cu). The first buried wiring 321 and the second through-wire 34 are simultaneously formed, and thus the first buried wiring 321 and the second through-wire 34 can be integrally continuously formed. In other words, the first buried wiring 321, the first through-wire 33, and the second through-wire 34 are simultaneously formed, and thus it is possible to reduce cost by further simplifying manufacturing processes.

As described above, the first individual wiring 31 and the supply wiring 32 are electrically connected to respective terminals (not illustrated) of the drive circuit 120 on the first principal surface 301.

In the present embodiment, as illustrated in FIGS. 7 and 11, bump electrodes 121 are provided on a surface of the drive circuit 120 on the drive circuit substrate 30 side, and the respective terminals (not illustrated) of the drive circuit 120 are electrically connected to the first individual wirings 31 and the supply wirings 32 via the bump electrodes 121.

Here, the bump electrode 121 includes, for example, a core portion 122 made of an elastic resin material and a bump wiring 123 which covers at least a part of a surface of the core portion 122.

The core portion 122 is made of a photosensitive insulating resin or a thermosetting insulating resin such as a polyimide resin, an acrylic resin, a phenol resin, a silicone resin, a silicone-modified polyimide resin, or an epoxy resin.

The core portion 122 is formed in a substantially semicylindrical shape before the drive circuit is connected to the drive circuit substrate 30. Here, the semicylindrical shape is a columnar shape in which an inner surface (bottom surface) in contact with the drive circuit is a flat surface, and an outer surface side which is a non-contact surface is a curved surface. Specifically, the substantially semicylindrical shape may include, for example, a substantially semicircular shape, a substantially semielliptical shape, and a substantially trapezoidal shape in a cross section.

The drive circuit 120 and the drive circuit substrate 30 relatively come close to each other, and thus a front end shape of the core portion 122 is elastically deformed to resemble surface shapes of the first individual wiring 31 and the supply wiring 32. Consequently, even if the drive circuit 120 or the drive circuit substrate 30 is warped or wavy, the core portion 122 is deformed in tracking thereof, and thus the bump electrodes 121 can be reliably connected to the first individual wirings 31 and the supply wirings 32. In other words, whereas the first individual wiring 31 is formed on the surface of the drive circuit substrate 30, the supply wiring 32 has the first buried wiring 321, and thus the recessed portion 322*a* is formed on the surface of the first connection wiring 322. Therefore, the first individual wiring 31 connected to the drive circuit 120 and the supply wiring 32 are different in heights in the third direction Z. Even in a case where the first individual wiring 31 and the supply wiring 32 having different heights are present, the core portion 122 is deformed, and thus the bump electrodes 121 can be reliably connected to the first individual wirings 31 and the supply wirings 32.

The core portion 122 is continuously formed linearly in the first direction X. A plurality of core portions 122 are arranged in the second direction Y. In the present embodiment, the core portions 122 provided at both ends of the drive circuit 120 in the second direction Y configure the bump electrodes 121 connected to the first individual wirings 31. The core portions 122 provided at the center side of the drive circuit 120 in the second direction Y configure the bump electrodes 121 connected to the supply wirings 32. The core portion 122 may be formed according to a photolithography technique or an etching technique.

In the bump wiring 123, at least a part of a surface of the core portion 122 is coated. The bump wiring 123 is made of metal or an alloy such as Au, Tiw, Cu, chromium (Cr), Ni, Ti, W, NiV, Al, palladium (Pd), or a lead-free solder, and may be formed a single layer thereof, and may be formed as a laminate of a plurality of species. The bump wirings 123 are deformed to resemble the surface shapes of the first individual wiring 31 and the supply wiring 32 due to elastic deformation of the core portions 122, and are electrically bonded to the first individual wirings 31 and the supply wirings 32. In the present embodiment, an adhesive layer 124 is provided between the drive circuit 120 and the drive circuit substrate 30, the drive circuit 120 and the drive circuit substrate 30 is bonded together via the adhesive layer 124, and thus contact states between the bump electrodes 121, and the first individual wirings 31 and the supply wirings 32 are maintained.

The bump wirings 123 are respectively electrically connected to the terminals (not illustrated) of the drive circuit 120. Specifically, the bump wiring 123 of the bump electrode 121 connected to the first individual wiring 31 is connected to a terminal used to supply a drive signal to the piezoelectric actuator 150 from the drive circuit 120. The bump wiring 123 of the bump electrode 121 connected to the supply wiring 32 is connected to a terminal used to receive a power source voltage or a control signal supplied from the external wiring substrate 130 via the supply wiring 32. A plurality of bump electrodes 121 connected to the supply wiring 32 are provided at a plurality of locations at a predetermined interval along the supply wiring 32. Consequently, a single supply wiring 32 can be electrically connected to the drive circuit 120 at a plurality of locations, and thus it is possible to reduce a voltage drop in the first direction X which is a longitudinal direction of the drive circuit 120.

In the present embodiment, the bump electrode 121 includes the core portion 122 and the bump wiring 123, but is not particularly limited thereto, and the bump electrode 121 may be, for example, a metal bump. The respective terminals of the drive circuit 120 may be connected to the first individual wirings 31 and the supply wirings 32 by performing brazing such as soldering, welding, diffusion bonding, or crimping via an anisotropic conductive adhesive (an ACP or an ACF), or a nonconductive adhesive (an NCP or an NCF).

As mentioned above, in the present embodiment, the drive circuit 120 is mounted on the first principal surface 301 of the drive circuit substrate 30, and thus a redundant space cannot be secured on the first principal surface 301 of the drive circuit substrate 30. In other words, a space between the first principal surface 301 of the drive circuit substrate 30 and the drive circuit 120 is defined by a height of the bump electrode 121. A height of the bump electrode 121 of the recording head 1 is, for example, 20 μm or less. Even in this configuration, the supply wiring 32 having the first buried wiring 321 is provided, and thus the supply wiring 32 of which a cross-sectional area is large and an electric resistance value is low can be disposed in a narrow space on the first principal surface 301. In a case where the first buried wiring 321 is not provided in the supply wiring 32, that is, the supply wiring 32 is provided without providing the first groove 304 on the first principal surface 301 of the drive circuit substrate 30, there is a restriction in a space on the first principal surface 301, and thus the supply wiring 32 cannot be formed high, and a cross-sectional area of the supply wiring 32 is reduced such that an electric resistance value is increased. In a case where a width of the supply wiring 32 is increased in order to reduce an electric resistance value of the supply wiring 32, the drive circuit substrate 30 is large-sized, particularly, in the second direction Y. In a case where the relatively thick supply wiring 32 is formed without providing the first groove 304 in the drive circuit substrate 30, it is hard to pattern the supply wiring 32 with high accuracy at high density due to a restriction in a photolithography method, and only the relatively thin supply wiring 32 can be formed. In the present embodiment, since a thickness of the first buried wiring 321 is defined by the first groove 304, and a pattern thereof is formed by the first groove 304, the first buried wiring 321 which is relatively thick, for example, having the thickness of about 20 μm to 40 μm can be formed at high density at a pitch of 40 μm to 50 μm, compared with a case where the supply wiring 32 is formed on the surface. Therefore, it is possible to reduce an electric resistance value by increasing a cross-sectional area of the first buried wiring 321. Connection to the external wiring 131 via the supply wiring 32 having a low electric resistance value, and thus it is possible to prevent poor supply of a power source voltage or a ground voltage. Particularly, it is possible to reduce the occurrence of a delay when the piezoelectric actuator 150 which is a drive element is driven at a high frequency.

Since the influence of a wiring resistance difference caused by a difference between wirings connected to the respective active portions of the piezoelectric actuators 150 can be reduced, a difference between voltages which are actually applied to the respective active portions can be reduced, and thus the respective active portions can be driven with equivalent characteristics (excluded volume). Consequently, it is possible to reduce a variation in an ejected ink weight and thus to reduce unevenness of printed matter.

As illustrated in FIGS. 7, 9, and 10, a second individual wiring 35 and an auxiliary wiring 36 are provided as a drive element connection wiring connected to the piezoelectric actuator 150 on the second principal surface 302 of the drive circuit substrate 30.

The second individual wiring 35 is electrically connected to the first through-wire 33, and is also electrically connected to the individual lead electrode 91 provided on the channel formation substrate 10, and is thus used to supply a drive signal from the drive circuit 120 to the first electrode 60 which is an individual electrode of the piezoelectric actuator 150 via the bump electrode 121, the first individual wiring 31, the first through-wire 33, the second individual wiring 35, and the individual lead electrode 91.

Specifically, a plurality of second individual wirings 35 are arranged in the first direction X at both ends of the drive circuit substrate 30 in the second direction Y. The second individual wiring 35 extends in the second direction Y, and covers an end of the first through-wire 33 at one end thereof so as to be electrically connected to the first through-wire 33. Specifically, the second individual wiring 35 is electrically connected to the individual lead electrode 91 provided on the channel formation substrate 10 via a bump electrode 37 which will be described later.

The auxiliary wiring 36 is electrically connected to the second through-wire 34, and is also electrically connected to the common lead electrode 92 provided on the channel formation substrate 10, and is used to supply the bias voltage (vbs) supplied from the external wiring 131 to the second electrode 80 which is a common electrode of the piezoelectric actuator 150 via the supply wiring 32, the second through-wire 34, the auxiliary wiring 36, and the common lead electrode 92.

The auxiliary wiring 36 includes a second buried wiring 361 buried in a second groove 306 provided on the second principal surface 302, and a second connection wiring 362 coating the second buried wiring 361.

The second groove 306 is provided at a position opposed to the first groove 304 provided on the first principal surface 301 in the third direction Z. In other words, each second groove 306 of the present embodiment is provided with same width as that of the first groove 304 at the same position as that of the first groove 304 in the second direction Y. The second groove 306 is provided linearly in the first direction X. In other words, in the same manner as the first grooves 304, six second grooves 306 for each string of the active portions of the piezoelectric actuators 150, that is, a total of twelve second grooves 306 are provided.

In the same manner as the first groove 304, the second groove 306 may be formed with high accuracy by performing, for example, anisotropic etching (wet etching) using an alkali solution. The first groove 304 and the second groove 306 may be simultaneously formed through anisotropic etching. Of course, the second groove 306 may be formed through dry etching or mechanical processing.

Since the first groove 304 and the second groove 306 are provided at the positions opposed to each other in the third direction Z, when a material having a linear expansion coefficient and an in-plane stress which are different from those of the drive circuit substrate 30 is buried in the first groove 304 and the second groove 306, it is possible to reduce a warping state of the drive circuit substrate 30 due to a difference between area ratios of the material buried in the first principal surface 301 and the second principal surface 302. In other words, in a case where an area ratio is different when a material having a linear expansion coefficient and an in-plane stress which are different from those of the drive circuit substrate 30 is buried in the first principal surface 301 and the second principal surface 302, the drive circuit substrate 30 is warped. In a case where the drive circuit substrate 30 is warped, there is concern that the drive circuit substrate 30 may be damaged, peeling between the drive circuit substrate 30 and the channel formation substrate 10 may occur, or a wiring may be disconnected.

The second buried wiring 361 is buried in the second groove 306. In the same manner as the first buried wiring 321 buried in the first groove 304, the second buried wiring 361 is made of metal such as copper (Cu), and may be formed according to, for example, electrolytic plating, electroless plating, or conductive paste printing.

The second connection wiring 362 is laminated to cover a plurality of second buried wirings 361. In the present embodiment, a single second connection wiring 362 is provided to cover all of the six second buried wirings 361 provided for each string of the active portions of the piezoelectric actuators 150. A laminate of an adhesion layer provided on the second buried wiring 361 side, such as titanium (Ti), and a conductive layer provided on the adhesion layer, such as gold (Au) may be used as the second connection wiring 362 in the same manner as the first connection wiring 322. Of course, layers made of other conductive materials may be laminated as the second connection wiring 362. The second connection wiring 362 may be formed according to, for example, a sputtering method. The second connection wiring 362 may be simultaneously formed with, for example, the second individual wiring 35. Consequently, it is possible to reduce cost by simplifying manufacturing processes.

As mentioned above, two auxiliary wirings 36 each including a plurality of (six in the present embodiment) second buried wirings 361 and the second connection wiring 362 covering all of the six second buried wirings 361 are arranged for each string of the active portions of the piezoelectric actuators 150, that is, in the second direction Y with a gap therebetween in the present embodiment.

As illustrated in FIG. 10, the second connection wiring 362 of each auxiliary wiring 36 extends between two auxiliary wirings 36 arranged in the second direction Y, and the extending portion thereof is electrically connected to the common lead electrode 92 provided on the channel formation substrate 10 via the bump electrode 37 as illustrated in FIG. 7.

Here, each of the bump electrodes 37 respectively connecting the second individual wiring 35 and the auxiliary wiring 36 to the individual lead electrode 91 and the common lead electrode 92 includes a core portion 371 made of an elastic resin material and a bump wiring 372 which is a metal film covering at least a part of a surface of the core portion 371 in the same as the bump electrode 121 provided on the drive circuit 120.

The core portion 371 is formed to have the same sectional shape by using the same material as that of the core portion 122 configuring the bump electrode 121 of the drive circuit 120. The core portion 371 is continuously disposed linearly in the first direction X. There are provided, in the second direction Y, a total of three core portions 371 including a total of two core portions 371 respectively provided outside the two strings of the active portions of the piezoelectric actuators 150, and a single core portion 371 provided between the two strings of the active portions of the piezoelectric actuators 150. The respective core portions 371 provided outside the two strings of the active portions of the piezoelectric actuators 150 configure the bump electrodes 37 for connecting the second individual wirings 35 to the individual lead electrodes 91. The core portion 371 provided between the two strings of the active portions of the piezoelectric actuators 150 configures the bump electrode 37 for connecting the auxiliary wiring 36 to the common lead electrode 92 of the two strings of the piezoelectric actuators 150.

Regarding the bump wiring 372 configuring the bump electrode 37 for connecting the second individual wiring 35 to the individual lead electrode 91, in the present embodiment, the second individual wiring 35 extends onto the core portion 371, and thus the second individual wiring 35 is used as the bump wiring 372.

Similarly, regarding the bump wiring 372 configuring the bump electrode 37 for connecting the auxiliary wiring 36 to the common lead electrode 92, in the present embodiment, the second connection wiring 362 extends onto the core portion 371, and thus the second connection wiring 362 is used as the bump wiring 372. Of course, the second individual wiring 35 and the second connection wiring 362 may be formed separately from the bump wirings 372, and parts thereof may be laminated on each other so as to be electrically connected to each other.

The second connection wirings 362 extend onto the core portion 371 at a plurality of locations at a predetermined interval in the first direction X. In other words, a plurality of bump electrodes 37 connecting the auxiliary wirings 36 to the common lead electrode 92 are provided at a predetermined interval in the first direction X. The auxiliary wiring 36 is electrically connected to one of the supply wirings 32 on the first principal surface 301 via the second through-wire 34. Thus, it is possible to substantially reduce an electric resistance value of the supply wiring 32 connected to the auxiliary wiring 36. In other words, the auxiliary wiring 36 is connected to a wiring having a low current capacity and can thus reduce an electric resistance value of the wiring. The auxiliary wiring 36 is electrically connected to one of the supply wirings 32 via a plurality of second through-wires 34 which are provided at a predetermined interval in the first direction X. Thus, it is possible to reduce a voltage drop in the supply wiring 32 and the auxiliary wiring 36 in the first direction X.

The auxiliary wiring 36 is electrically connected to the common lead electrode 92 at a plurality of locations in the second direction Y via the bump electrodes 37. Thus, a voltage drop in the second electrode 80 in the first direction X is reduced, and thus a variation between bias voltages applied to the respective active portions can be reduced.

Electrical connection between the second individual wiring 35 and the auxiliary wiring 36, and the individual lead electrode 91 and the common lead electrode 92 is not limited to using the bump electrodes 37, and may be performed by using metal bumps. The second individual wiring and the auxiliary wiring may be connected to the individual lead electrode and the common lead electrode by performing brazing such as soldering, welding, diffusion bonding, or crimping via an anisotropic conductive adhesive (an ACP or an ACF), or a nonconductive adhesive (an NCP or an NCF).

As mentioned above, since the individual lead electrode 91 and the common lead electrode 92 on the channel formation substrate 10 are electrically connected to the second individual wiring 35 and the auxiliary wiring 36 on the drive circuit substrate 30 via the bump electrodes 37, even if the channel formation substrate 10 or the drive circuit substrate 30 is warped or is wavy, the core portion 371 is deformed in tracking thereof, and thus the individual lead electrode 91 and the common lead electrode 92 can be reliably electrically connected to the second individual wiring 35 and the auxiliary wiring 36 on the drive circuit substrate 30.

The channel formation substrate 10 and the drive circuit substrate 30 are adhered to each other via an adhesive layer 38, and thus the second individual wiring 35 and the second connection wiring 362 which are the bump wiring 372 configuring the bump electrode 37 are fixed in a state of being in contact with the individual lead electrode 91 and the common lead electrode 92.

A holding portion 160 which is a space in which the piezoelectric actuators 150 are disposed is formed between the channel formation substrate 10 and the drive circuit substrate 30 due to the adhesive layer 38 bonding the channel formation substrate 10 to the drive circuit substrate 30. In other words, a height of the holding portion 160 in the third direction Z is defined by the bump electrode 37, but the core portion 371 of the bump electrode 37 has to be made large in order to heighten the holding portion 160, and a planar space for providing the core portion 371 is necessary in order to make the core portion 371 large, so that the channel formation substrate 10, the drive circuit substrate 30, and the like become large-sized. In other words, the holding portion 160 is preferably formed as low as possible at such a height that driving of the piezoelectric actuator 150 is not hindered, and thus it is possible to miniaturize the recording head in the second direction Y and the third direction Z. In the recording head 1 of the present embodiment, a size of a space required for displacement of the piezoelectric actuator 150 is about 20 μm.

In the present embodiment, the auxiliary wiring 36 provided on the second principal surface 302 of the drive circuit substrate 30 has the second buried wiring 361 provided in the second groove 306, and thus the auxiliary wiring 36 having a small electric resistance value can be provided in the holding portion 160 having a small height. In other words, in a case where the auxiliary wiring 36 is provided without providing the second groove 306 on the second principal surface 302 of the drive circuit substrate 30, there is a restriction in a height of the holding portion 160, and thus the auxiliary wiring 36 cannot be formed high, and a cross-sectional area of the auxiliary wiring 36 is reduced such that an electric resistance value is increased. In a case where a width of the auxiliary wiring 36 is increased in order to reduce an electric resistance value of the auxiliary wiring 36, the drive circuit substrate 30 or the channel formation substrate 10 is large-sized in the second direction Y. In a case where a relatively thick wiring is formed without providing the second groove 306 in the drive circuit substrate 30, it is hard to pattern the wiring with high accuracy at high density due to a restriction in a photolithography method, and only the relatively thin wiring can be formed. In the present embodiment, since a thickness of the second buried wiring 361 is defined by the second groove 306, and a pattern thereof is formed by the second groove 306, the second buried wiring 361 which is relatively thick, for example, having the thickness of about 20 μm to 40 μm can be formed at high density at a pitch of 40 μm to 50 μm, compared with a case where the wiring is formed on the surface. Therefore, it is possible to reduce an electric resistance value by increasing a cross-sectional area of the second buried wiring 361.

As illustrated in FIGS. 1 to 3, a bonding body of the channel formation substrate 10, the drive circuit substrate 30, the communication plate 15, and the nozzle plate 20 is fixed to a case member 40 forming the manifold 100 which communicates with a plurality of pressure generation chambers 12. The case member 40, which has the substantially same shape as that of the communication plate 15 in a plan view, is bonded to the drive circuit substrate 30, and is also bonded to the communication plate 15. Specifically, the case member 40 has a recessed portion 41 having a depth sufficient to accommodate the channel formation substrate 10 and the drive circuit substrate 30 on the drive circuit substrate 30 side. The recessed portion 41 has an opening area larger than that of the surface of the drive circuit substrate 30 bonded to the channel formation substrate 10. An opening surface of the recessed portion 41 on the nozzle plate 20 is sealed with the communication plate 15 in a state in which the channel formation substrate 10 and the like are accommodated in the recessed portion 41. The case member 40 is provided with a third manifold portion 42 having a concave shape is formed on both sides of the recessed portion 41 in the second direction Y. The manifold 100 of the present embodiment is formed by the third manifold portion 42, and the first manifold portion 17 and the second manifold portion 18 provided in the communication plate 15.

For example, a resin or metal may be used as a material of the case member 40. The case member 40 can be mass produced at low cost by shaping a resin material.

The compliance substrate 45 is provided on the surface of the communication plate 15 on the nozzle plate 20 side. The compliance substrate 45 seals the openings of the first manifold portion 17 and the second manifold portion 18 on the nozzle plate 20 side. In the present embodiment, the compliance substrate 45 includes a sealing film 46 and a fixation substrate 47. The sealing film 46 is configured with a flexible thin film (for example, a thin film 20 μm or less thick, made of polyphenylene sulfide (PPS) or stainless steel (SUS)), and the fixation substrate 47 is made of a hard material such as metal, for example, stainless steel (SUS). Since a region of the fixation substrate 47 facing the manifold 100 is an opening 48 which is completely empty, one surface of the manifold 100 is a compliance portion 49 which is a flexible portion sealed with only the flexible sealing film 46.

The case member 40 is provided with guide paths 44 which communicate with the manifold 100 and are used to supply ink to the manifold 100. The case member 40 is provided with a connection port 43 to which the drive circuit substrate 30 is exposed and into which the external wiring substrate 130 is inserted, and the external wiring substrate 130 inserted into the connection port 43 is connected to the supply wirings 32 of the drive circuit substrate 30.

In the recording head 1 having such a configuration, when ink is ejected, the ink is incorporated from a liquid storage portion in which the ink is stored via the guide path 44, and a channel inside from the manifold 100 to the nozzles 21 is filled with the ink. Thereafter, a voltage is applied to each piezoelectric actuator 150 corresponding to the pressure generation chamber 12 according to a signal from the drive circuit 120, and thus the vibration plate 50 is flexurally deformed along with the piezoelectric actuator 150. Consequently, the pressure in the pressure generation chamber 12 is increased, and thus ink droplets are ejected from predetermined nozzles 21.

The recording head 1 which is a liquid ejection head of the present embodiment includes the channel formation substrate 10 in which the pressure generation chamber 12 communicating with the nozzles 21 ejecting ink which is a liquid; the piezoelectric actuator 150 which is provided in the channel formation substrate 10 and is a drive element causing a pressure change in the pressure generation chamber 12; and the drive circuit substrate 30 which is a wiring substrate provided with the supply wiring 32 which is a wiring connected to the terminal portion 131*a* of the external wiring 131, in which the supply wiring 32 provided on the drive circuit substrate 30 includes the first buried wiring 321 which is a buried wiring buried in the first groove 304 which is a groove provided in the drive circuit substrate 30, and the first connection wiring 322 which is a connection wiring covering a surface of the first buried wiring 321, in which, in a plan view from the third direction Z which is a perpendicular direction to the first principal surface 301 which is a surface of the drive circuit substrate 30 on which the supply wiring 32 is provided, the first buried wiring 321, the first connection wiring 322, and the terminal portion 131*a* of the external wiring 131 are formed at an overlapping position, and the recessed portion 322*a* is provided at a position corresponding to the first buried wiring 321 on a surface of the first connection wiring 322 on an opposite side to the drive circuit substrate 30, and in which, in the second direction Y intersecting the first direction X which is an extension direction of the supply wiring 32 on the first principal surface 301 on which the supply wiring 32 of the drive circuit substrate 30 is provided, the width $W_1$ of the first connection wiring 322 is larger than the width $W_2$ of the first buried wiring 321, the width $W_3$ of the terminal portion 131*a* of the external wiring 131 is larger than the width $W_4$ of the recessed portion 322*a* of the first connection wiring 322, and the terminal portion 131*a* is provided across the recessed portion 322*a* of the first connection wiring 322.

As mentioned above, in a plan view from the third direction Z, the first buried wiring 321, the first connection wiring 322, and the terminal portion 131*a* are provided at an overlapping position, and thus it is possible to remove a portion having a great electric resistance value, configured with only the first connection wiring 322 between the supply wiring 32 and the external wiring 131. Therefore, it is possible to prevent poor supply of a power source voltage, a ground voltage, a drive signal, a bias voltage, or the like in the middle of the supply wiring 32 connecting the external wiring 131 to the drive circuit 120 or the piezoelectric actuator 150.

Since, in a plan view from the third direction Z, the first buried wiring 321, the first connection wiring 322, and the terminal portion 131*a* are provided at an overlapping position, even if the recessed portion 322*a* is formed in the first connection wiring 322, the width $W_3$ of the terminal portion 131*a* of the external wiring 131 is larger than the width $W_4$ of the recessed portion 322*a*, and the terminal portion 131*a* is provided across the recessed portion 322*a* of the first connection wiring 322, so that the terminal portion 131*a* can be reliably connected to the first connection wiring 322 provided on the first principal surface 301 of the drive circuit substrate 30 on which the recessed portion 322*a* is not provided. Therefore, it is possible to suppress a reduction in a contact area between the external wiring 131 and the supply wiring 32, and thus to prevent poor supply of a power source voltage, a ground voltage, a drive signal, a bias voltage, or the like in the connection portion. Since the first buried wiring 321 is covered with the first connection wiring 322, it is possible to prevent the occurrence of migration between the supply wirings 32 adjacent to each other, and also to reliably bond the first connection wiring 322 to the terminal portion 131*a* of the external wiring 131.

Since the first connection wiring 322 can be reliably connected to the terminal portion 131*a* of the external wiring 131 even if the recessed portion 322*a* is formed in the first connection wiring 322, a process of removing the recessed portion 322*a*, that is, a process of forming the first connection wiring 322 to be thick and a process of grinding the first connection wiring 322 until the recessed portion 322*a* disappears are unnecessary, and thus it is possible to reduce cost.

In the recording head 1 of the present embodiment, the width $W_3$ of the terminal portion 131*a* is preferably larger than the width $W_2$ of the first buried wiring 321 in the second direction Y which is a direction intersecting the first direction X which is an extension direction of the supply wiring 32 on the first principal surface 301 which is a surface on which the supply wiring 32 as a wiring of the drive circuit substrate 30 which is a wiring substrate is provided. Consequently, the recessed portion 322*a* can be formed without performing special processing on the first connection wiring 322. Since the width $W_3$ of the terminal portion 131*a* is larger than the width $W_2$ of the first buried wiring 321 in a case where the width $W_4$ of the recessed portion 322*a* is smaller than the width $W_2$ of the first buried wiring 321, the terminal portion 131*a* can be reliably connected to the first connection wiring 322 in which the recessed portion 322*a* is not formed and is close to the first buried wiring 321.

In the recording head 1 of the present embodiment, the drive circuit substrate 30 which is a wiring substrate is provided with the drive circuit 120 having a switching element for driving the piezoelectric actuator 150 which is a drive element, and at least a part of the supply wiring 32 which is a wiring preferably connects the external wiring 131 to the drive circuit 120. As mentioned above, since the drive circuit 120 is mounted on the drive circuit substrate 30, even if there is a restriction in a height for providing the supply wiring 32, the supply wiring 32 having the first buried wiring 321 is provided, and thus the supply wiring 32 having a small electric resistance value can be disposed.

In the recording head 1 of the present embodiment, the drive circuit 120 and the drive circuit substrate 30 which is a wiring substrate are preferably electrically connected to each other via the bump electrode 121 which is a bump provided on either of the drive circuit 120 and the drive circuit substrate 30. Consequently, the bump electrodes 121 are deformed into wirings connected to the drive circuit 120 on the drive circuit substrate 30 and having different heights, and thus the drive circuit 120 can be reliably electrically connected. In other words, in the present embodiment, since the first individual wiring 31 is formed on the surface of the drive circuit substrate 30, but the supply wiring 32 has the first buried wiring 321, the recessed portion 322*a* is provided on the surface of the first connection wiring 322. Therefore, the first individual wiring 31 and the supply wiring 32 connected to the drive circuit 120 have different heights in the third direction Z. Even if the first individual wiring 31 and the supply wiring 32 having different heights as mentioned above, the core portion 122 is deformed, the bump electrodes 121 can be reliably connected to the first individual wiring 31 and the supply wiring 32.

In the recording head 1 of the present embodiment, the supply wiring 32 which is a wiring and the terminal portion 131*a* are preferably electrically connected to each other via the nonconductive adhesive 140 which bonds the drive circuit substrate 30 which is a wiring substrate to the external wiring 131. Consequently, since the supply wiring 32 and the external wiring 131 can be reliably connected to each other even if both thereof are disposed at high density, it is possible to miniaturize the drive circuit substrate 30 and the external wiring substrate 130 by disposing the supply wirings 32 and the external wirings 131 at high density.

In the recording head 1 of the present embodiment, preferably, the drive circuit substrate 30 which is a wiring substrate is laminated on the channel formation substrate 10, and the supply wiring 32 which is a wiring is provided on the drive circuit substrate 30 on an opposite side to the channel formation substrate 10. Consequently, it is possible to easily connect the supply wiring 32 of the drive circuit substrate 30 to the external wiring 131.

In the recording head 1 of the present embodiment, preferably, the second individual wiring 35 and the auxiliary wiring 36 which are drive element connection wirings connected to the piezoelectric actuator 150 which is a drive element are provided on the second principal surface 302 which is an opposite surface to the first principal surface 301 which is a surface on which the supply wiring 32 which is a wiring of the drive circuit substrate 30 as a wiring substrate is provided, and the second individual wiring 35 and the auxiliary wiring 36 are electrically connected to the piezoelectric actuator 150 via the bump electrodes 37 which are bumps provided on either of the channel formation substrate 10 and the drive circuit substrate 30. Consequently, it is possible to reliably connect drive elements disposed at high density to the supply wirings 32 provided on the drive circuit substrate 30 via bumps at low cost.

In the recording head 1 of the present embodiment, the bump electrode 37 which a bump preferably includes the elastic core portion 371 and the bump wiring 372 which is a metal film provided on a surface of the core portion 371. Consequently, even if the channel formation substrate 10 or the drive circuit substrate 30 is warped, the core portion 371 of the bump electrode 37 is deformed, and thus the bump electrode 37 can be reliably connected to the piezoelectric actuator 150.

Figure 12:
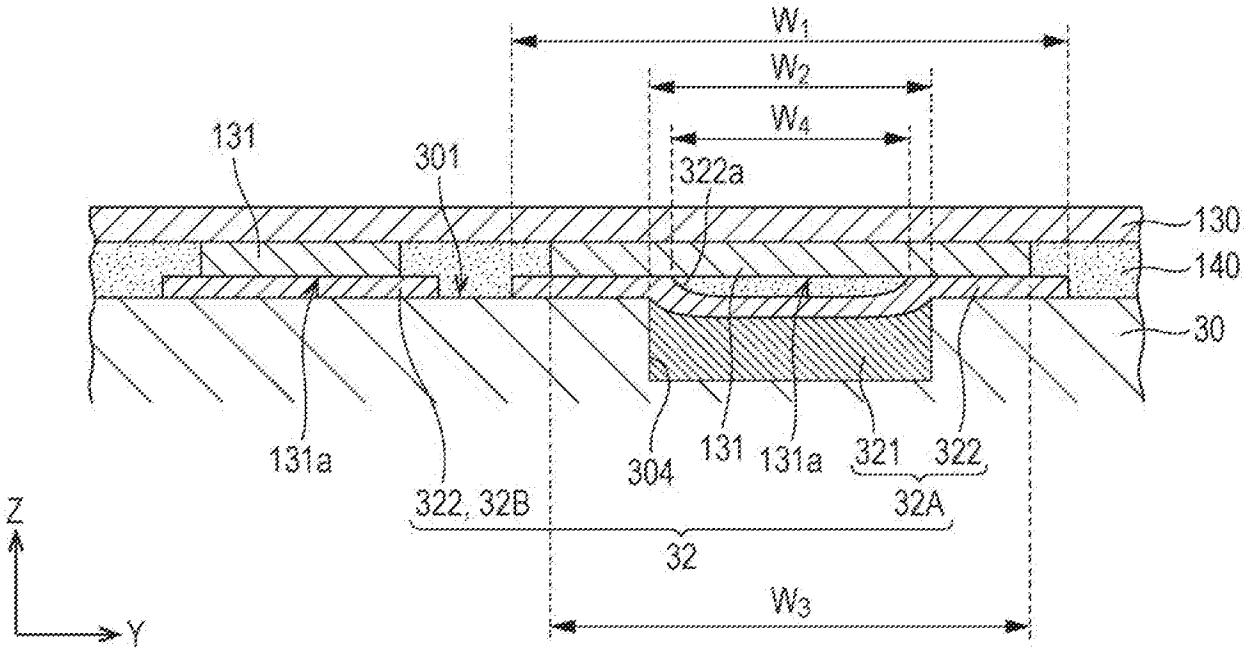
FIG. 12 is a sectional view of a drive circuit according to a modification example of Embodiment 1.

In the present embodiment, each supply wiring 32 includes the first buried wiring 321 and the first connection wiring 322, but is not particularly limited thereto, and both of the supply wiring 32 including the first buried wiring 321 and the first connection wiring 322 and the supply wiring 32 including only the first connection wiring 322 without the first buried wiring 321 may be provided. Such an example is illustrated in FIG. 12. FIG. 12 is a sectional view taken along the line XII-XII, illustrating a modification example of the recording head according to Embodiment 1 of the invention.

As illustrated in FIG. 12, the supply wiring 32 includes a first supply wiring 32A including the first buried wiring 321 and the first connection wiring 322, and a second supply wiring 32B including only the first connection wiring 322 without the first buried wiring 321.

The first supply wiring 32A is the supply wiring 32 through which a relatively large current flows from the external wiring 131 to the drive circuit 120 or the piezoelectric actuator 150. Here, the supply wiring 32 through which a relatively large current flows may include wirings for a drive signal, a power source, and a ground. The wiring for a drive signal includes the supply wiring 32 used to supply the drive signal (COM) applied to the first electrode 60 which is an individual electrode of the piezoelectric actuator 150, and the supply wiring 32 used to supply the bias voltage (vbs) applied to the second electrode 80 which is a common electrode of the piezoelectric actuator 150. The wirings for a power source and a ground include the supply wirings 32 used to supply the power source potential (VDD), the ground potential (GND), and the high power source potential (VHV). The first buried wiring 321 is provided in supply wiring 32 through which a relatively large current flows, and thus it is possible to prevent poor supply of a relatively large current in the supply wiring 32.

The second supply wiring 32B is the supply wiring 32 through which a small current flows compared with the first supply wiring 32A through which a relatively large current such as a drive signal, a power source current, or a ground current flows. Here, the supply wiring 32 through which a small current flows includes, for example, the supply wiring 32 used to supply a control signal for the drive circuit 120.

As mentioned above, even if the second supply wiring 32B is configured with only the first connection wiring 322, portions of the first supply wiring 32A and the second supply wiring 32B connected to the terminal portions 131*a* have an identical height in the third direction Z, and thus the terminal portions 131*a* of the external wirings 131 provided on the single external wiring substrate 130 can be connected to the first supply wiring 32A and the second supply wiring 32B. In other words, in the present embodiment, since the first buried wiring 321 is provided in the first supply wiring 32A, even if the recessed portion 322*a* is provided on the surface of the first connection wiring 322, the terminal portion 131*a* of the external wiring 131 is connected to the first connection wiring 322 provided on the first principal surface 301 of the drive circuit substrate 30 on which the recessed portion 322*a* is not provided, and thus the portion of the first supply wiring 32A connected to the terminal portion 131*a* can be made to have the same height as that of the portion of the second supply wiring 32B connected to the terminal portion 131*a*. In other words, it is hard to simultaneously connect the external wirings 131 provided on the single external wiring substrate 130 to a plurality of supply wirings 32 having different heights. Particularly, in a case where the supply wirings 32 disposed at high density are connected to the external wirings 131 via the nonconductive adhesive 140, the supply wirings 32 are in direct contact with and electrically connected to the terminal portions 131*a* of the external wirings 131, and thus it is hard to simultaneously connect the supply wirings 32 having different heights to the terminal portions 131*a*. In the present embodiment, portions of the first supply wiring 32A having the first buried wiring 321 and the second supply wiring 32B not having the first buried wiring 321, connected to the terminal portions 131*a* can be made to have an identical height, and thus the first supply wiring 32A and the second supply wiring 32B can be reliably connected to the terminal portions 131*a* even via the nonconductive adhesive 140.

In the recording head 1 of the present embodiment, the first supply wiring 32A which is a wiring having the first buried wiring 321 which is a buried wiring is preferably a wiring for a drive signal. The first supply wiring 32A having the first buried wiring 321 is preferably wirings for a power source and a ground.

Consequently, the first buried wiring 321 is provided in the first supply wiring 32A through which a relatively large current flows, and thus it is possible to prevent poor supply due to a voltage drop. Since the terminal portion 131*a* is connected to a position of the first supply wiring 32A not in contact with the recessed portion 322*a*, even if the first buried wiring 321 is not provided in the second supply wiring 32B through which a relatively small current flows, the portions of the first supply wiring 32A and the second supply wiring 32B connected to the terminal portions 131*a* can be made to have an identical height in the third direction Z, and thus the terminal portions 131*a* can be relatively connected to the first supply wiring 32A and the second supply wiring 32B. Since the first buried wiring 321 is not provided in the second supply wiring 32B, the supply wirings 32 can be disposed at high density in the second direction Y, and thus it is possible to miniaturize the drive circuit substrate 30 and the recording head 1.

Embodiment 2

Figure 13:
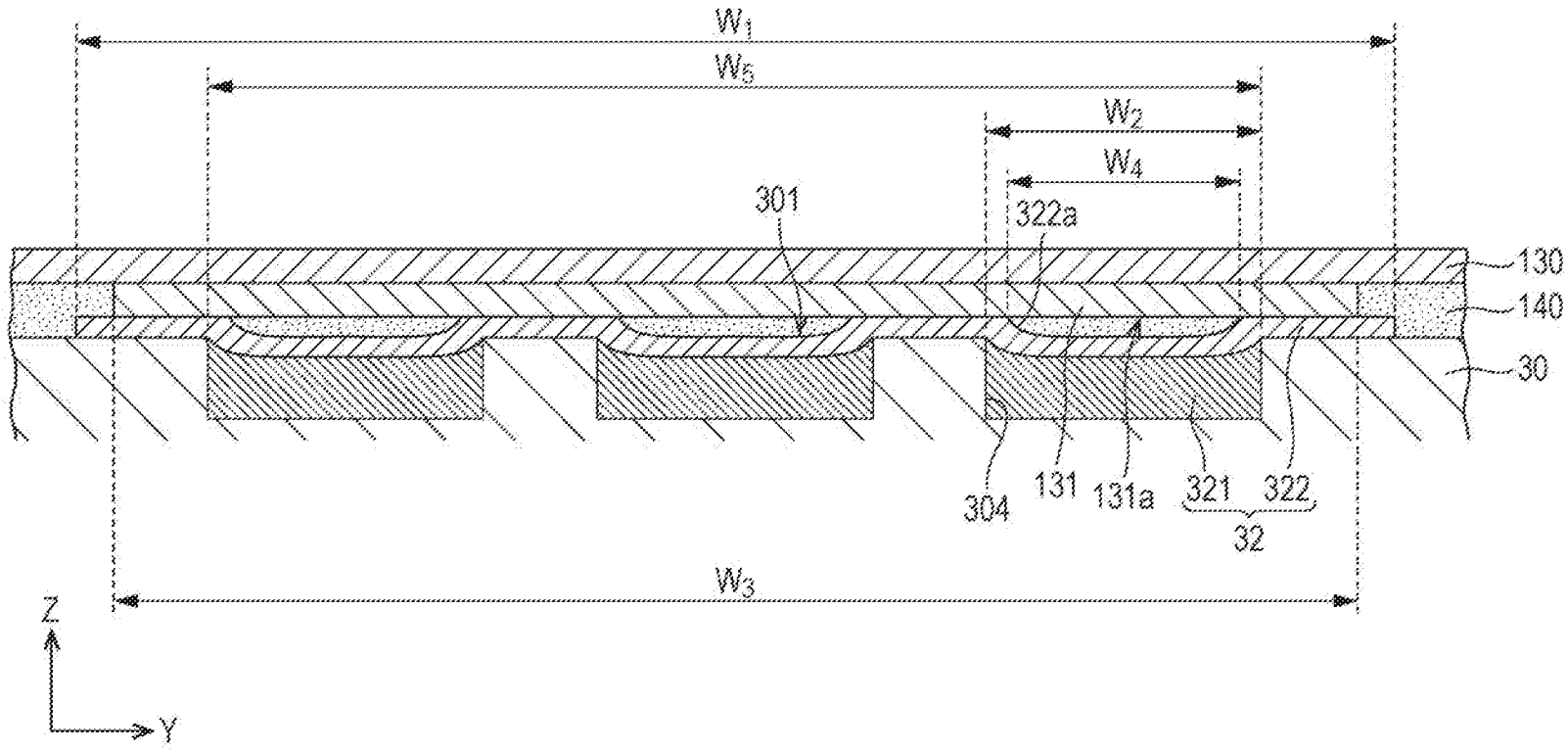
FIG. 13 is a sectional view illustrating principal elements of a drive circuit substrate according to Embodiment 2.

FIG. 13 is an enlarged sectional view of main elements of an ink jet type recording head which is an example of a liquid ejection head according to Embodiment 2, and is a sectional view taken along the line XIII-XIII in FIG. 6. The same members as those in the above-described embodiment are given the same reference numerals, and repeated description will be omitted.

As illustrated in FIG. 13, in the supply wiring 32 of the present embodiment, three first buried wirings 321 are provided in a single first connection wiring 322 in the present embodiment. In other words, the first connection wiring 322 is continuously provided over the three first buried wirings 321.

Also in this configuration, the width $W_1$ of the first connection wiring 322 is larger than exhaust width $W_2$ of each of the three first buried wirings 321. The width $W_1$ of the first connection wiring 322 is larger than a width $W_5$ of a region in which the three first buried wirings 321 are provided.

In the supply wiring 32, the recessed portion 322*a* is provided on the surface of the first connection wiring 322 for each first buried wiring 321. In other words, three recessed portions 322*a* are provided in a single first connection wiring 322.

The terminal portion 131*a* of the external wiring 131 provided on the external wiring substrate 130, connected to the supply wiring 32, is continuously provided over the three first buried wirings 321 in the second direction Y. In other words, the terminal portion 131*a* is provided across each recessed portion 322*a* in the second direction Y in all of the recessed portions 322*a*. In other words, the terminal portion 131*a* is continuously provided over the first connection wiring 322 on both sides of all of the recessed portions 322*a* in the second direction Y. In other words, the width $W_3$ of the terminal portion 131*a* in the second direction Y is larger than the width $W_2$ of each of the three first buried wirings 321. The width $W_3$ of the terminal portion 131*a* is larger than the width $W_5$ of the region in which the three first buried wirings 321 are provided. In other words, a relationship of $W_3>W_5>W_2$ is satisfied.

Even in this configuration, in the above-described Embodiment 1, in a plan view from the third direction Z, the first buried wiring 321, the first connection wiring 322, and the terminal portion 131*a* are provided at an overlapping position, and thus it is possible to remove a portion having a great electric resistance value, configured with only the first connection wiring 322 between the supply wiring 32 and the external wiring 131. Therefore, it is possible to prevent poor supply of a power source voltage, a ground voltage, a drive signal, a bias voltage, or the like in the middle of the supply wiring 32 connecting the external wiring 131 to the drive circuit 120 or the piezoelectric actuator 150.

Since, in a plan view from the third direction Z, the first buried wiring 321, the first connection wiring 322, and the terminal portion 131*a* are provided at an overlapping position, even if the recessed portion 322*a* is formed in the first connection wiring 322, the width $W_3$ of the terminal portion 131*a* of the external wiring 131 is larger than the width $W_4$ of the recessed portion 322*a*, and the terminal portion 131*a* is provided across the recessed portion 322*a* of the first connection wiring 322, so that the terminal portion 131*a* can be reliably connected to the first connection wiring 322 provided on the first principal surface 301 of the drive circuit substrate 30 on which the recessed portion 322*a* is not provided. Therefore, it is possible to suppress a reduction in a contact area between the external wiring 131 and the supply wiring 32, and thus to prevent poor supply of a power source voltage, a ground voltage, a drive signal, a bias voltage, or the like in the connection portion. Since the first buried wiring 321 is covered with the first connection wiring 322, it is possible to prevent the occurrence of migration between the supply wirings 32 adjacent to each other, and also to reliably bond the first connection wiring 322 to the terminal portion 131*a* of the external wiring 131.

Since the first connection wiring 322 can be reliably connected to the terminal portion 131*a* of the external wiring 131 even if the recessed portion 322*a* is formed in the first connection wiring 322, a process of removing the recessed portion 322*a*, that is, a process of forming the first connection wiring 322 to be thick and a process of grinding the first connection wiring 322 until the recessed portion 322*a* disappears are unnecessary, and thus it is possible to reduce cost.

Embodiment 3

Figure 14:
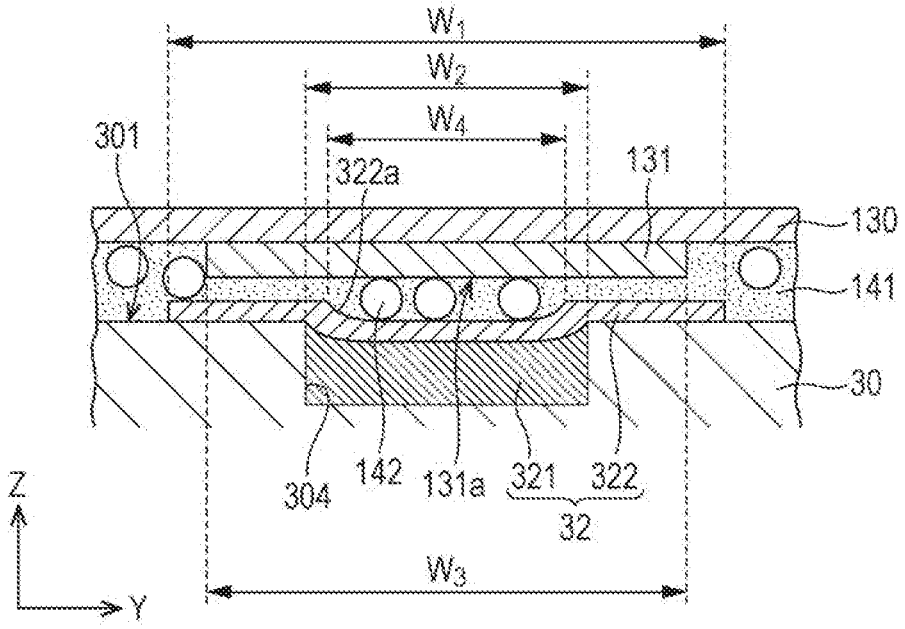
FIG. 14 is a sectional view illustrating principal elements of a drive circuit substrate according to Embodiment 3.

FIG. 14 is an enlarged sectional view of main elements of an ink jet type recording head which is an example of a liquid ejection head according to Embodiment 3, and is a sectional view taken along the line XIV-XIV in FIG. 6. The same members as those in the above-described embodiment are given the same reference numerals, and repeated description will be omitted.

As illustrated in FIG. 14, the supply wiring 32 which is a wiring provided on the first principal surface 301 of the drive circuit substrate 30 is connected to the terminal portion 131*a* of the external wiring 131 of the external wiring substrate 130. Here, the supply wiring 32 is connected to the terminal portion 131*a* via an anisotropic conductive adhesive (an ACP or an ACF) 141. An outer diameter of each of conductive pillars 142 contained in the anisotropic conductive adhesive 141 is more than a depth of the recessed portion 322*a* in the third direction Z provided on the surface of the first connection wiring 322 of the supply wiring 32. As mentioned above, since the outer diameter of the conductive pillar 142 is more than the depth of the recessed portion 322*a* in the third direction Z, the terminal portion 131*a* can be reliably connected to the bottom surface of the recessed portion 322*a*. Even if the terminal portion 131*a* and the bottom surface of the recessed portion 322*a* are electrically connected to each other, in a case where, in the third direction Z, the terminal portion 131*a* is provided to face the first connection wiring 322 on both sides of the recessed portion 322*a* in the second direction Y, a case where the first connection wiring 322 and the terminal portion 131*a* facing each other are not directly electrically connected to each other on both sides of the recessed portion 322*a* also includes that the terminal portion 131*a* is provided across the recessed portion 322*a*. Of course, even if the outer diameter of the conductive pillar 142 is more than the depth of the recessed portion 322*a* in the third direction Z, the first connection wiring 322 and the terminal portion 131*a* on both sides of the recessed portion 322*a* in the second direction Y may be electrically connected to each other via the conductive pillars 142. In other words, the conductive pillar 142 having the outer diameter more than the depth of the recessed portion 322*a* in the third direction Z is used, and thus the terminal portion 131*a* can be reliably electrically connected to the first connection wiring 322 having the recessed portion 322*a*.

As mentioned above, in a plan view in the third direction Z, the first buried wiring 321, the first connection wiring 322, and the terminal portion 131*a* are provided at an overlapping position, and thus it is possible to remove a portion having a great electric resistance value, configured with only the first connection wiring 322 between the supply wiring 32 and the external wiring 131. Therefore, it is possible to prevent poor supply of a power source voltage, a ground voltage, a drive signal, a bias voltage, or the like in the middle of the supply wiring 32 connecting the external wiring 131 to the drive circuit 120 or the piezoelectric actuator 150.

Since, in a plan view from the third direction Z, the first buried wiring 321, the first connection wiring 322, and the terminal portion 131*a* are provided at an overlapping position, even if the recessed portion 322*a* is formed in the first connection wiring 322, the width $W_3$ of the terminal portion 131*a* of the external wiring 131 is larger than the width $W_4$ of the recessed portion 322*a*, and the terminal portion 131*a* is provided across the recessed portion 322*a* of the first connection wiring 322, so that the terminal portion 131*a* can be reliably connected to the first connection wiring 322 provided on the first principal surface 301 of the drive circuit substrate 30 on which the recessed portion 322*a* is not provided. Therefore, it is possible to suppress a reduction in a contact area between the external wiring 131 and the supply wiring 32, and thus to prevent poor supply of a power source voltage, a ground voltage, a drive signal, a bias voltage, or the like in the connection portion. Since the first buried wiring 321 is covered with the first connection wiring 322, it is possible to prevent the occurrence of migration between the supply wirings 32 adjacent to each other, and also to reliably bond the first connection wiring 322 to the terminal portion 131*a* of the external wiring 131.

Since the first connection wiring 322 can be reliably connected to the terminal portion 131*a* of the external wiring 131 even if the recessed portion 322*a* is formed in the first connection wiring 322, a process of removing the recessed portion 322*a*, that is, a process of forming the first connection wiring 322 to be thick and a process of grinding the first connection wiring 322 until the recessed portion 322*a* disappears are unnecessary, and thus it is possible to reduce cost.

In the present embodiment, the supply wiring 32 and the terminal portion 131*a* are electrically connected to each other via the anisotropic conductive adhesive 141. As mentioned above, since the supply wiring 32 and the terminal portion 131*a* are electrically connected to each other via the anisotropic conductive adhesive 141, and can thus be reliably connected to each other even if the supply wirings 32 and the external wirings 131 are disposed at high density, it is possible to miniaturize the drive circuit substrate 30 and the external wiring substrate 130 by disposing the supply wirings 32 and the external wirings 131 at high density.

OTHER EMBODIMENTS

As mentioned above, the embodiments of the invention have been described, but a functional unit configuration of the invention is not limited to the above-described configuration.

Figure 15:
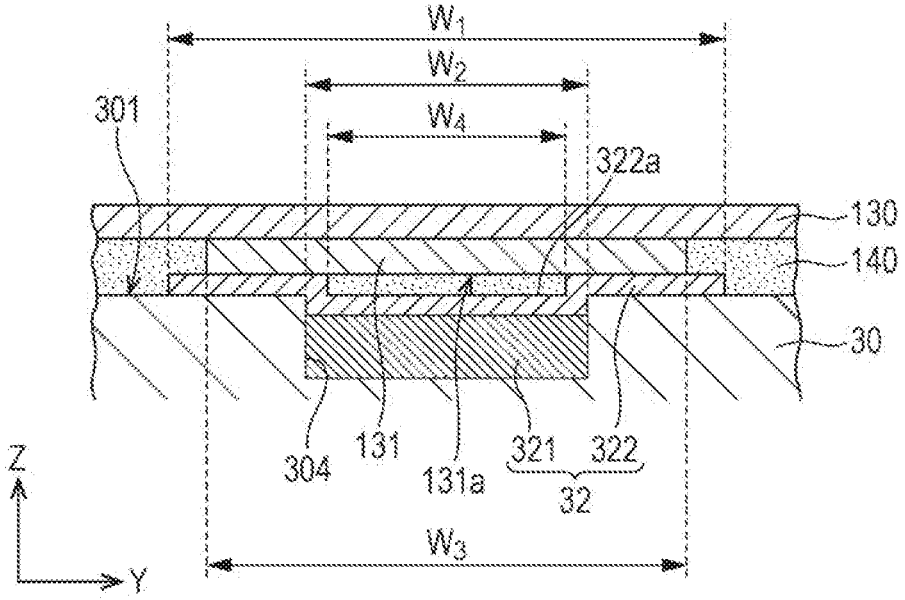
FIG. 15 is a sectional view illustrating principal elements of a drive circuit substrate according to still another embodiment.

For example, in the above-described respective embodiments, a description has been made of a configuration in which the recessed portion 322*a* of the surface of the first connection wiring 322 is a recessed curve surface, and this is only an example. For example, as illustrated in FIG. 15, the recessed portion 322*a* of the surface of the first connection wiring 322 may be formed in a shape of which a bottom surface is parallel to the first principal surface 301, a side surface is perpendicular to the first principal surface 301, and a section is rectangular. Regarding the recessed portion 322*a* of the first connection wiring 322, a recess formed of the first buried wiring 321 and the first groove 304 of the drive circuit substrate 30 may be formed in the same shape as that of the recessed portion 322*a*. Even in this configuration, since the width $W_3$ of the terminal portion 131*a* is larger than the width $W_2$ of the first buried wiring 321 in the second direction Y, and the terminal portion 131*a* is provided across the recessed portion 322*a*, the terminal portion 131*a* can be reliably connected to the supply wiring 32, and thus it is possible to suppress a reduction in a contact area between the terminal portion 131*a* and the supply wiring 32. In the example illustrated in FIG. 15, a side surface of the recessed portion 322*a* is perpendicular to the first principal surface 301, but is not particularly limited thereto, and may be inclined with respect to the third direction Z.

For example, in the above-described respective embodiments, the terminal portion 131*a* of the external wiring 131 and the supply wiring 32 are connected to each other via the nonconductive adhesive 140 or the anisotropic conductive adhesive 141, but is not particularly limited thereto, and the terminal portion 131*a* and the supply wiring 32 may be connected to each other through brazing such as soldering, welding, or diffusion bonding. However, the supply wiring 32 and the external wiring 131 can be reliably connected to each other even if both thereof are disposed at high density by using the nonconductive adhesive 140 or the anisotropic conductive adhesive 141 of the above-described respective embodiments. Above all, particularly, using the nonconductive adhesive 140 can cope with the supply wirings 32 and the external wirings 131 disposed at high density, and thus it is possible to further achieve miniaturization.

In the above-described respective embodiments, in the second direction Y, the width $W_3$ of the terminal portion 131*a* is smaller than the width $W_1$ of the first connection wiring 322, but is not particularly limited thereof, and the width $W_3$ of the terminal portion 131*a* may be larger than the width $W_1$ of the first connection wiring 322.

In the above-described respective embodiments, the second buried wiring 361 is provided on the second principal surface 302, but is not particularly limited thereof, and the second buried wiring 361 may not be provided.

In the above-described respective embodiments, the bump electrode 121 is provided in the drive circuit 120, but is not particularly limited, and, for example, the bump electrode may be provided on the first principal surface 301 side of the drive circuit substrate 30. Similarly, the bump electrode 37 is provided on the second principal surface 302 of the drive circuit substrate 30, but is not particularly limited thereto, and the bump electrode may be provided on the channel formation substrate 10 side. Positions of the bump electrodes 121 and 37 are not limited to the positions in the above-described respective embodiments.

In the above-described respective embodiments, the wirings of the drive circuit substrate 30 and the channel formation substrate 10 are connected to each other via the bump electrode 37, but are not particularly limited thereto, and the drive circuit 120 may be connected to the respective electrodes of the piezoelectric actuator 150 via bonding wires. The drive circuit 120 may be connected to the piezoelectric actuator 150 by forming wirings over the drive circuit substrate 30 and the channel formation substrate 10 on a bonding body of the drive circuit substrate 30 and the channel formation substrate 10.

In the above-described respective embodiments, the single drive circuit 120 is provided for the two strings of the piezoelectric actuators 150, but this is only an example. For example, the drive circuit 120 may be provided for each string of the piezoelectric actuators 150, and a plurality of drive circuits 120, for example, two or more drive circuits 120 which are separate in the first direction X may be provided for a single string of the piezoelectric actuators 150. The invention is applicable not only to the recording head 1 including the drive circuit substrate 30 which is a wiring substrate provided with the drive circuit 120 but also to a recording head including a wiring substrate not provided with the drive circuit 120.

In the above-described respective embodiments, the thin film type piezoelectric actuator 150 has been described as a drive element causing a pressure change in the pressure generation chamber 12, but this is only an example, and there may be the use of, for example, a thick film type piezoelectric actuator formed according to a method such as attaching green sheets, or a longitudinal vibration type piezoelectric actuator in which a piezoelectric material and an electrode formation material are alternately laminated and which expand and contract in an axial direction. There may be the use of an actuator in which a heating element is disposed as a drive element in a pressure generation chamber, and a liquid droplet is ejected from a nozzle opening by bubbles which are generated due to heating of the heating element, or a so-called electrostatic actuator in which static electricity is generated between a vibration plate and an electrode, and the vibration plate is deformed by electrostatic force such that a liquid droplet is ejected from a nozzle opening.

Figure 16:
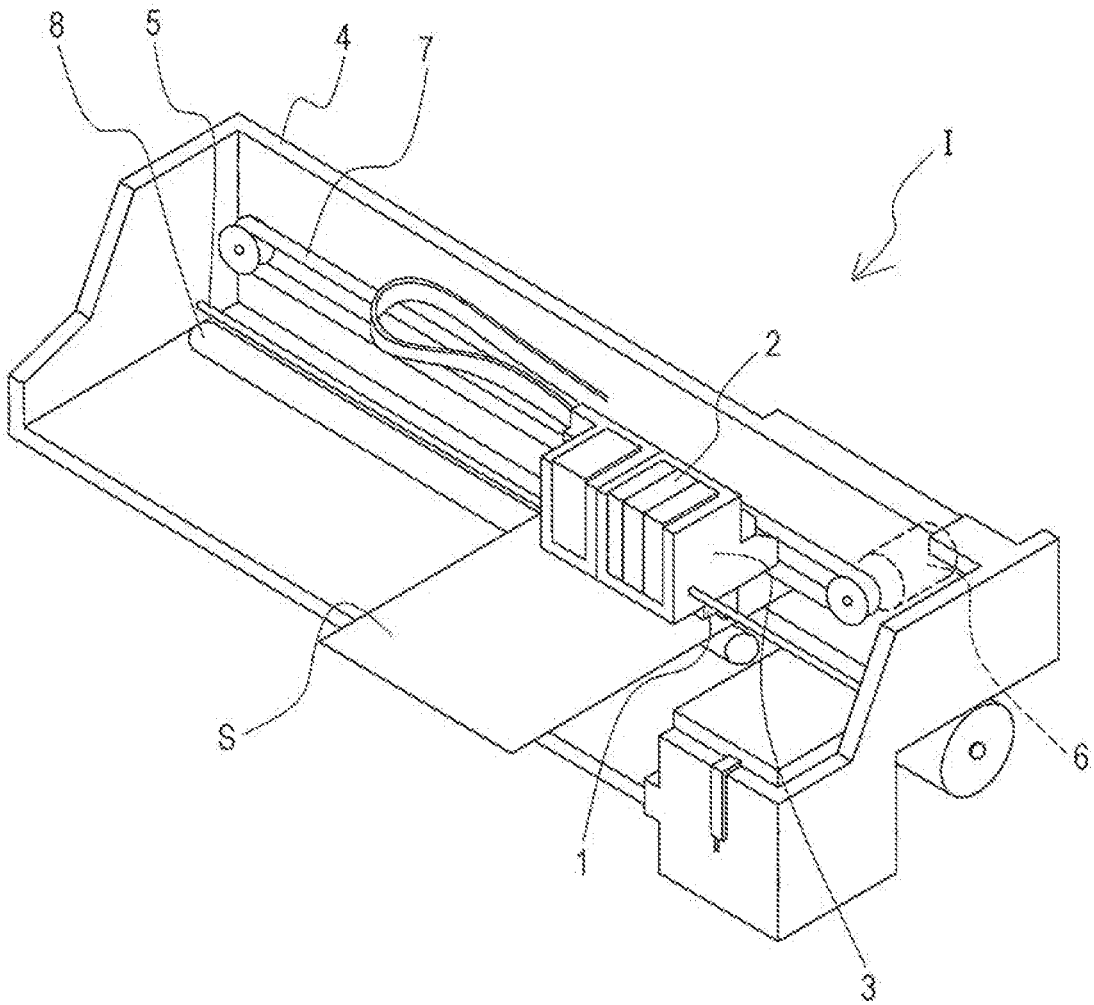
FIG. 16 is a schematic diagram illustrating an ink jet type recording device according to one embodiment.

The recording head 1 of the embodiments is mounted on an ink jet type recording apparatus which is a liquid ejection apparatus. FIG. 16 is a schematic diagram illustrating an example of the ink jet type recording apparatus.

As illustrated, in an ink jet type recording apparatus I, a cartridge 2 configuring an ink supply portion is attachably and detachably provided in the recording head 1, and a carriage 3 mounted with the recording head 1 is provided at a carriage shaft 5 attached to an apparatus body 4, so as to be movable.

Drive force from a drive motor 6 is transferred to the carriage 3 via a plurality of gears (not illustrated) and a timing belt 7, and thus the carriage 3 mounted with the recording head 1 is moved along the carriage shaft 5. On the other hand, the apparatus body 4 is provided with a transport roller 8 as a transport portion, and is a recording sheet S which is a recording medium such as paper is transported by the transport roller 8. A transport portion transporting the recording sheet S is not limited to a transport roller, and may be a belt or a drum.

In the ink jet type recording apparatus I, a description has been made of a case where the recording head 1 is mounted on the carriage 3, and is moved in a main scanning direction, but is not particularly limited thereto, and, for example, the invention may be applied to a so-called line type recording apparatus in which the recording head 1 is stationary, and processing is performed by moving the recording sheet S such as paper in a sub-scanning direction.

In the above example, the ink jet type recording apparatus I has a configuration in which the cartridge 2 which is a liquid storage portion is mounted on the carriage 3, but is not particularly limited thereto, and a liquid storage portion such as an ink tank is fixed to the apparatus body 4, and the liquid storage portion and the recording head 1 may be connected to each other via a tube, specifically, a supply tube. A liquid storage portion may not be mounted on the ink jet type recording apparatus.

The invention is widely applicable to general heads, and is applicable to, for example, recording heads such as various ink jet type recording heads used in image recording apparatuses such as printers, color material ejection heads used to manufacture color filters of a liquid crystal display or the like, electrode material ejection heads used to form electrodes of an organic EL display and a field emission display (FED), and bioorganic material ejection heads used to manufacture bio chips.

The invention is widely applicable to electronic devices, and is also applicable to electronic devices other than a recording head. Examples of the electronic devices may include an ultrasonic device, a motor, a pressure sensor, a pyroelectric element, and a ferroelectric element. Such electronic devices also include complete bodies using the electronic devices, for example, an apparatus ejecting a liquid or the like, using the head, an ultrasonic sensor using the ultrasonic device, a robot using the motor as a drive source, an IR sensor using the pyroelectric element, and a ferroelectric memory using the ferroelectric element.

What is claimed is:

1. A liquid ejection head comprising:

a channel formation substrate that is provided with a pressure generation chamber which communicates with a nozzle ejecting a liquid;

a drive element that is provided on the channel formation substrate and causes a pressure change in the pressure generation chamber; and a wiring substrate that is provided with a wiring connected to a terminal portion of an external wiring, wherein the wiring provided on the wiring substrate includes a buried wiring buried in a groove provided in the wiring substrate, and a connection wiring covering a surface of the buried wiring, wherein, in a plan view from a perpendicular direction to a surface of the wiring substrate on which the wiring is provided, the buried wiring, the connection wiring, and the terminal portion of the external wiring are formed at an overlapping position, wherein a recessed portion is provided at a position corresponding to the buried wiring on a surface of the connection wiring on an opposite side to the wiring substrate, and wherein, in a direction intersecting an extension direction of the wiring on the surface of the wiring substrate on which the wiring is provided, a width of the connection wiring is larger than a width of the buried wiring, a width of the terminal portion of the external wiring is larger than a width of the recessed portion, and the terminal portion is provided across the recessed portion of the connection wiring.

2. The liquid ejection head according to claim 1, wherein, in the direction intersecting the extension direction of the wiring on the surface of the wiring substrate on which the wiring is provided, the width of the terminal portion is larger than the width of the buried wiring.

3. A liquid ejection apparatus comprising the liquid ejection head according to claim 2.

4. The liquid ejection head according to claim 1, wherein the wiring having the buried wiring is a wiring for a drive signal.

5. A liquid ejection apparatus comprising the liquid ejection head according to claim 3.

6. The liquid ejection head according to claim 1, wherein the wiring having the buried wiring is a wiring for a power source and a ground.

7. A liquid ejection apparatus comprising the liquid ejection head according to claim 6.

8. The liquid ejection head according to claim 1, wherein the wiring substrate is provided with a drive circuit having a switching element for driving the drive element, and wherein at least a part of the wiring connects the external wiring to the drive circuit.

9. The liquid ejection head according to claim 8, wherein the drive circuit and the wiring substrate are electrically connected to each other via a bump provided in either one of the drive circuit and the wiring substrate.

10. A liquid ejection apparatus comprising the liquid ejection head according to claim 9.

11. A liquid ejection apparatus comprising the liquid ejection head according to claim 8.

12. The liquid ejection head according to claim 1, wherein the wiring and the terminal portion are electrically connected to each other via a nonconductive adhesive which connects the wiring substrate and the external wiring to each other.

13. A liquid ejection apparatus comprising the liquid ejection head according to claim 12.

14. The liquid ejection head according to claim 1, wherein the wiring and the terminal portion are electrically connected to each other via an anisotropic conductive adhesive.

15. A liquid ejection apparatus comprising the liquid ejection head according to claim 14.

16. The liquid ejection head according to claim 1, wherein the wiring substrate is laminated on the channel formation substrate, and wherein the wiring is provided on the wiring substrate on an opposite side to the channel formation substrate.

17. The liquid ejection head according to claim 16, wherein a drive element connection wiring connected to the drive element is provided on an opposite surface of the wiring substrate to the surface on which the wiring is provided, and wherein the drive element connection wiring and the drive element are electrically connected to each other via a bump provided on either one of the channel formation substrate and the wiring substrate.

18. The liquid ejection head according to claim 17, wherein the bump includes an elastic core portion, and a metal film provided on a surface of the core portion.

19. A liquid ejection apparatus comprising the liquid ejection head according to claim 1.

20. An electronic device comprising:

a wiring substrate that is provided with a wiring connected to a terminal portion of an external wiring, wherein the wiring provided on the wiring substrate includes a buried wiring buried in a groove provided in the wiring substrate, and a connection wiring covering a surface of the buried wiring, wherein, in a plan view from a perpendicular direction to a surface of the wiring substrate on which the wiring is provided, the buried wiring, the connection wiring, and the terminal portion of the external wiring are formed at an overlapping position, wherein a recessed portion is provided at a position corresponding to the buried wiring on a surface of the connection wiring on an opposite side to the wiring substrate, and wherein, in a direction intersecting an extension direction of the wiring on the surface of the wiring substrate on which the wiring is provided, a width of the connection wiring is larger than a width of the buried wiring, a width of the terminal portion of the external wiring is larger than a width of the recessed portion, and the terminal portion is provided across the recessed portion of the connection wiring.

* * * * *